US010779586B2

(12) United States Patent
Langer et al.

(10) Patent No.: US 10,779,586 B2
(45) Date of Patent: Sep. 22, 2020

(54) LEG APPAREL

(71) Applicant: FALKE KGaA, Schmallenberg (DE)

(72) Inventors: Angela Langer, Schmallenberg (DE); Claudius Brinkmann, Bad Fredeburg (DE); Georg Wüllner, Schmallenberg-Bödefeld (DE)

(73) Assignee: FALKE KGaA, Schmallenberg (DE)

( * ) Notice: Subject to any disclaimer, the term of this patent is extended or adjusted under 35 U.S.C. 154(b) by 723 days.

(21) Appl. No.: 14/641,195

(22) Filed: Mar. 6, 2015

(65) Prior Publication Data

US 2015/0173428 A1 Jun. 25, 2015

Related U.S. Application Data

(63) Continuation of application No. PCT/EP2013/068914, filed on Sep. 12, 2013.

(30) Foreign Application Priority Data

Sep. 12, 2012 (DE) ..... 10 2012 216 180

(51) Int. Cl.
*A41B 11/00* (2006.01)
*A41B 11/02* (2006.01)
(Continued)

(52) U.S. Cl.
CPC ..... *A41D 13/0015* (2013.01); *A41D 1/08* (2013.01); *A41B 11/003* (2013.01)

(58) Field of Classification Search
CPC .. A41D 13/0015; A41D 1/08; A41D 13/0002; A41B 11/00; A41B 11/003
(Continued)

(56) References Cited

U.S. PATENT DOCUMENTS 3,013,420 A 12/1961 Cormier
3,159,990 A 12/1964 Monday
(Continued)

FOREIGN PATENT DOCUMENTS

AT 193541 11/1957
AT 11230 7/2010
(Continued)

OTHER PUBLICATIONS

State of Intellectual Property Office of the People's Republic of China, English version of "Notification of First Office Action," issued in connection with Chinese Application No. 201380047479.8, dated Nov. 27, 2015, 15 pages.
(Continued)

*Primary Examiner* — Jameson D Collier
(74) *Attorney, Agent, or Firm* — Hanley, Flight & Zimmerman, LLC

(57) ABSTRACT

In order to provide an article of leg apparel, in particular a stocking, which is suitable for reducing the risk of injury to the wearer of the leg apparel, particularly during sports activities and to achieve compensation of possible functional imbalances in the musculoskeletal system of the wearer, it is proposed that the leg apparel includes at least one compression region in which, in the worn state, the leg apparel exerts a compression effect on the leg of the wearer of the leg apparel, and includes at least one stimulus-inducing structure which, in the worn state, is arranged on an inside of the leg apparel facing toward the leg of the wearer of the leg apparel.

32 Claims, 18 Drawing Sheets

(51) Int. Cl.

| | |
|---|---|
| ***A41D 1/06*** | (2006.01) |
| ***A41D 13/02*** | (2006.01) |
| ***A41D 17/02*** | (2006.01) |
| ***A41D 13/00*** | (2006.01) |
| ***A41D 1/08*** | (2018.01) |

(58) Field of Classification Search
USPC ..... 2/79, 227, 239–242, 919
See application file for complete search history.

(56) References Cited

U.S. PATENT DOCUMENTS

| | | | | |
|---|---|---|---|---|
| 3,216,223 | A | 11/1965 | Margulies | |
| 4,195,497 | A * | 4/1980 | Goldstein | A41B 11/00 66/178 R |
| 4,216,547 | A * | 8/1980 | Picchione | A41D 13/0015 2/22 |
| 4,333,976 | A * | 6/1982 | Okamoto | D06M 15/643 428/446 |
| 4,372,998 | A * | 2/1983 | Shimada | A41D 27/245 139/117 |
| 5,263,923 | A | 11/1993 | Fujimoto | |
| 5,329,640 | A * | 7/1994 | Hourigan | A41B 11/00 2/239 |
| 5,791,164 | A * | 8/1998 | Carroll | D04B 21/04 66/194 |
| 5,857,947 | A | 1/1999 | Dicker et al. | |
| 6,138,281 | A * | 10/2000 | Chiaruttini | A41B 11/00 2/239 |
| 6,311,334 | B1 | 11/2001 | Reinhardt et al. | |
| 6,314,584 | B1 * | 11/2001 | Errera | A41B 11/008 2/239 |
| 6,378,138 | B1 * | 4/2002 | Ridgley | A41B 11/00 2/239 |
| 6,446,264 | B2 | 9/2002 | Fairhurst et al. | |
| 6,673,421 | B1 | 1/2004 | Andrews et al. | |
| 7,007,517 | B2 * | 3/2006 | Menzies | A41B 11/02 66/185 |
| 7,434,423 | B1 | 10/2008 | Reid, Jr. et al. | |
| 7,516,498 | B2 * | 4/2009 | Torry | A41D 1/08 2/69 |
| 7,934,267 | B2 | 5/2011 | Nordstrom et al. | |
| 7,996,924 | B2 | 8/2011 | Wright et al. | |
| 2004/0016041 | A1 | 1/2004 | Uno et al. | |
| 2004/0255358 | A1 * | 12/2004 | Ota | A41D 13/0015 2/69 |
| 2005/0115282 | A1 * | 6/2005 | Starbuck | D04B 1/24 66/176 |
| 2005/0193461 | A1 | 9/2005 | Caillibotte et al. | |
| 2006/0026740 | A1 * | 2/2006 | Vargas | A41B 11/02 2/239 |
| 2006/0080754 | A1 * | 4/2006 | Baron | A41D 13/002 2/85 |
| 2006/0169004 | A1 * | 8/2006 | Belluye | A41D 1/084 66/177 |
| 2006/0230488 | A1 * | 10/2006 | Rudolph | A41D 1/086 2/69 |
| 2006/0260024 | A1 * | 11/2006 | Lee | A41B 11/128 2/239 |
| 2007/0074328 | A1 | 4/2007 | Melhart et al. | |
| 2008/0083055 | A1 | 4/2008 | Onda | |
| 2008/0178359 | A1 * | 7/2008 | Grilliot | A41D 13/05 2/16 |
| 2008/0295216 | A1 | 12/2008 | Nordstrom et al. | |
| 2008/0295230 | A1 | 12/2008 | Wright et al. | |
| 2009/0025115 | A1 | 1/2009 | Duffy et al. | |
| 2009/0062704 | A1 | 3/2009 | Brown et al. | |
| 2009/0133181 | A1 | 5/2009 | Nordstrom et al. | |
| 2009/0165190 | A1 * | 7/2009 | Araki | A61F 13/064 2/240 |
| 2009/0275873 | A1 | 11/2009 | Achtelstetter | |
| 2010/0004563 | A1 | 1/2010 | Lipshaw | |
| 2010/0010568 | A1 | 1/2010 | Brown | |
| 2010/0050313 | A1 | 3/2010 | Shackelford, Jr. | |
| 2010/0050699 | A1 * | 3/2010 | Kolmes | A41B 9/00 66/174 |
| 2010/0090365 | A1 * | 4/2010 | Schuette | C08J 3/091 264/178 F |
| 2010/0130903 | A1 | 5/2010 | Rock | |
| 2010/0256717 | A1 | 10/2010 | Brown | |
| 2010/0299799 | A1 | 12/2010 | Belluye et al. | |
| 2011/0040222 | A1 | 2/2011 | Weihermueller | |
| 2011/0083246 | A1 | 4/2011 | Vitarana | |
| 2011/0092872 | A1 | 4/2011 | Christiansen | |
| 2011/0107502 | A1 | 5/2011 | Dalhausser et al. | |
| 2011/0302686 | A1 | 12/2011 | Chapuis | |
| 2012/0070608 | A1 | 3/2012 | Rock et al. | |
| 2014/0230124 | A1 | 8/2014 | Wilms-Otto | |

FOREIGN PATENT DOCUMENTS

| | | | | |
|---|---|---|---|---|
| CN | 101715306 | | 5/2010 | |
| CN | 201459349 | | 5/2010 | |
| CN | 101766334 | | 7/2010 | |
| CN | 201929003 | U | 8/2011 | |
| CN | 102264252 | | 11/2011 | |
| CN | 102273741 | | 12/2011 | |
| CN | 202085728 | | 12/2011 | |
| CN | 202143449 | U | 2/2012 | |
| DE | 1842303 | | 11/1961 | |
| DE | 19946019 | | 3/2003 | |
| DE | 102009050031 | | 3/2011 | |
| DE | 202012007243 | | 8/2012 | |
| EP | 0553615 | | 8/1993 | |
| EP | 0919145 | | 6/1999 | |
| EP | 0964091 | | 12/1999 | |
| EP | 1074652 | | 2/2001 | |
| EP | 1241286 | | 10/2001 | |
| FR | 2115802 | | 7/1972 | |
| GB | 1444445 | A * | 7/1976 | A41F 9/00 |
| GB | 1552320 | A * | 9/1979 | A41B 11/00 |
| GB | 2029468 | | 3/1980 | |
| JP | WO 2007046298 | A1 * | 4/2007 | A41C 1/003 |
| JP | 2012-052276 | | 3/2012 | |
| WO | WO 2007147980 | A2 * | 12/2007 | A41B 11/003 |
| WO | 2012114209 | | 8/2012 | |
| WO | 2013053370 | | 4/2013 | |

OTHER PUBLICATIONS

State of Intellectual Property Office of the People's Republic of China, English version of "Notification of First Office Action," issued in connection with Chinese Application No. 201380047524.X, dated Nov. 17, 2015, 23 pages.

International Searching Authority, "Written Opinion," issued in connection with PCT Application No. PCT/EP2013/068916, dated Dec. 11, 2013, 6 pages.

International Searching Authority, English version of "International Search Report," issued in connection with PCT Application No. PCT/EP2013/068916, dated Dec. 11, 2013, 6 pages.

State of Intellectual Property Office of the People's Republic of China, English version of "Notification of Second Office Action," issued in connection with Chinese Application No. 201380047524.X, dated Sep. 26, 2016, 20 pages.

Hairu, Rough English machine translation of "Knitting Technology," China Textile Press, pp. 71-75, Jun. 2004, 13 pages.

United States Patent and Trademark Office, "Restriction," issued in connection with U.S. Appl. No. 14/641,215, dated Aug. 2, 2017 (8 pages).

Chinese Patent Office, English version of "Notification of the Third Office Action," issued in connection with CN Application No. 201380047524.X, dated Jun. 16, 2017 (23 pages).

International Searching Authority, "International Search Report," issued in connection with PCT Application No. PCT/EP2013/068914, dated Dec. 11, 2013, 6 pages.

International Searching Authority, "Written Opinion," issued in connection with PCT Application No. PCT/EP2013/068914, dated Dec. 11, 2013, 6 pages.

(56) References Cited

OTHER PUBLICATIONS

German Patent Office, "First Office Action," issued in connection with German Application No. 10 2012 216 180.5, dated Apr. 25, 2013, 5 pages.
European Patent Office, "European Search Report", issued in connection with European Patent Application No. 17175200.9, dated Sep. 5, 2017, 6 pages.
European Patent Office, English machine translation of "European Search Report", issued in connection with European Patent Application No. 17175094.6, dated Oct. 9, 2017, 6 pages.
United States Patent and Trademark Office, "Non-Final Office Action" issued in connection with U.S. Appl. No. 14/641,215, dated Jan. 26, 2018, 54 pages.
English version European Patent Office, "Notice of Opposition," issued in connection with European Patent No. 2895020, on Apr. 17, 2018, 48 pages.
G.G. Hohlbaum, "The medical compression stocking," Schattauer Verlag, 1987, Germany, 147 pages (Partial English translation included).
Photographs of samples of a pantyhose "Compressana magic" and of sports trunks "Compressana magic pants" and the respective packaging, 2 pages.
A variety of articles from professional journals published in the years Jan. through Mar. 1999 through 2001, reporting on the product "Compressana magic," 36 pages.
An invoice issued by the Italian manufacturing company Calzificio Pinelli to the German sales company Compressana GmbH, related to the delivery of trunks and pantyhoses of the type "magic", dated Jun. 3, 1999, 1 page.
Information materials and advertising materials of the company Compressana GmbH concerning the pantyhose "Compressana magic" and the trunks "Compressana magic pants", which allegedly were distributed on the tradeshow "Expopharm 1999" in Leipzig, Germany, together with a letter to the management of the tradeshow dated Sep. 28, 1999, to which these information and advertising materials allegedly were attached, 13 pages.
An excerpt from the price list Jan. 2001 of the company Compressana GmbH, wherein the pantyhose "Compressana magic" and the trunks "Compressana magic pants" are offered for sale, 3 pages.
English version European Patent Office, "Notice of Opposition," issued in connection with European Patent No. 2895021, on Apr. 18, 2018, 45 pages.
United States Patent and Trademark Office, "Final Office action," issued in connection with U.S. Appl. No. 14/641,215, dated Jun. 27, 2018, 28 pages.
China National Intellectual Property Administration, "First Office Action," issued in connection with Chinese Patent Application No. 201811018930.4, dated Nov. 25, 2019, 26 pages. English version included.
European Patent Office, "Short Communication Reporting Opponent Letter," issued in connection with European Patent Application No. 13762119.9, dated Aug. 7, 2019, 2 pages. Rough machine translated English version included.
European Patent Office, "Brief of the Opponent in the Opposition Proceedings Against the Corresponding European Patent No. 2 895 020," issued in connection with the European Patent Application No. 13762119.9, mailed Aug. 15, 2019, 29 pages. Rough machine translated English version included.
Wikipedia Contributors, "Musculus Erector Spinae and Musculus Triceps Brachii," The Free Encyclopedia, Aug. 8, 2019, 14 pages. Rough machine translated English version included.
U.S. Patent and Trademark Office, "Non-Final Office Action," issued in connection with U.S. Appl. No. 14/641,215, dated May 2, 2019, 22 pages.
European Patent Office, "Short Communication Reporting Opponent Letter," issued in connection with European Patent Application No. 13762120.7, dated Aug. 7, 2019, 2 pages. Rough machine translated English version included.
European Patent Office, "Brief of the Opponent in the Opposition Proceedings Against the Corresponding European Patent No. 2 895 021," issued in connection with the European Patent Application No. 13762120.7, mailed Aug. 15, 2019, 30 pages. Rough machine translated English version included.
China National Intellectual Property Administration, "Notification of First Office Action and Search Report," issued in connection with Chinese Patent Application No. 201810756316.1, dated Jul. 25, 2019, 18 pages. English version included.
Chinese Patent Office, "First Office Action," issued in connection with Chinese Patent Application No. 201811019637.X, dated Mar. 9, 2020, 18 pages. English version included.
United States Patent and Trademark Office, "Final Office Action," issued in connection with U.S. Appl. No. 14/641,215, dated Apr. 9, 2020, 45 pages.
China Intellectual Property Administration, "Notification of the Second Office Action," issued in connection with Chinese Patent Application No. 201811018930.4, dated Jun. 23, 2020, 38 pages. English translation included.
Liu, Sen and Yang, Biling, "Introduction to Textile Dyeing," Beijing China Textile & Apparel Press, Mar. 31, 2017, 6 pages. English translation included.
Wang, Lu, "Sportswear Design Innovation," China Light Industry Press, Sep. 30, 2008, 4 pages. English translation included.

* cited by examiner

LEG APPAREL

RELATED APPLICATION

This application is a continuation application of PCT/EP2013/068914, filed on Sep. 12, 2013, which claims priority to DE 10 2012 216 180, filed on Sep. 12, 2012, both of which are hereby incorporated herein by reference.

FIELD OF DISCLOSURE

The present invention relates to an item of leg apparel.

The expression "leg apparel" covers, in particular, stockings, socks and every other type of hosiery including tights and trousers, for example, shorts and three-quarter length trousers, leggings and leg warmers (both short and long).

SUMMARY OF THE INVENTION

It is an object of the present invention to provide an item of leg apparel of this type which is suitable for reducing the risk of injury to the wearer of the leg apparel, particularly during sports activities and to achieve balancing out of possible functional imbalances in the musculoskeletal system of the wearer and to achieve performance optimisation in the sensory activity.

This object is achieved according to the invention with a leg apparel, in particular a stocking which comprises at least one compression region in which, in the worn state, the leg apparel exerts a compression effect on the leg of the wearer of the leg apparel, and at least one stimulus-inducing structure which, in the worn state, is arranged on an inside of the leg apparel facing toward the leg of the wearer of the leg apparel.

The present invention is based on the concept of exerting a proprioceptive stimulating effect on the wearer of the leg apparel by means of the stimulus-inducing structure, wherein the proprioceptive stimulating effect of the stimulus-inducing structure is amplified by the simultaneous compression effect of the leg apparel on the leg of the wearer.

From the field of physiology, it is known that a neurophysiological initiation of the proprioceptors of the wearer (that is, the receptors which enable the perception and control of the current position of the body of the wearer in space, in particular the muscle spindles, the Golgi tendon organ and the joint receptors) can be achieved through stimulation via the skin.

Through stimulation of the proprioceptors of the body (neurophysiological initiation), improved synchronisation and optimisation of the recruited muscles of the wearer is achieved, which becomes noticeable in improved physical stability, body balance and body posture.

Thus by stimulation of the proprioceptors, not only is the risk of injury reduced, particularly during sports activity, but balancing out of functional imbalances in the musculoskeletal system can also be achieved.

An improvement in body stability and/or a reduction in imbalances in the musculoskeletal system bring about a balanced, symmetrical posture of the wearer, which results in lower loading, a delayed fatiguing tendency and a prolonged tendency in the wearer to feel a sense of wellbeing.

The proprioceptive stimulation of the musculature of the wearer of the leg apparel brings about a reduced risk of injury through incorrect movements and overstretching, as well as optimisation and synchronisation of the bodily coordination of the wearer.

The leg apparel according to the invention enables the positive effect of proprioceptive stimulation to be used, including particularly in the domain of mass sports, for preventative uses, for example in the business field, and/or in the wellness or cosmetic fields.

The leg apparel according to the invention is a garment worn close to the body which enables effective proprioceptive stimulation of the musculature of the wearer in a simple and easily usable manner.

The leg apparel according to the invention can be configured, in particular, as a knee length stocking, a sock or as leggings.

The proprioceptive stimulation desired according to the invention is achieved, in particular, through a specific attachment of at least one stimulus-inducing structure having functional elements which exert a sensory stimulating effect on the musculature of the wearer, on the inside of the leg apparel facing toward the body of the wearer.

The stimulus-inducing structure is preferably arranged at a position of the leg apparel which, in the worn state of the leg apparel, is associated with a region of the leg of the wearer which has the greatest possible proprioceptor density.

Preferred regions of the arrangement of the stimulus-inducing structure are the courses of the myofascial chains which run helically upwardly, starting at the foot, via the leg region to the head.

In a preferred embodiment of the leg apparel according to the invention, it is provided that the sole region of the leg apparel remains free from stimulus-inducing structures, in order reliably to prevent potential faulty stimulation at this site.

By means of isolated application of pressure on the skin of the wearer along a muscle chain of the wearer, stimulation of the muscle activity of the wearer can be achieved.

Since the compression effect of the compression region amplifies the proprioceptive stimulating effect of the stimulus-inducing structure, it is favourable if the stimulus-inducing structure is arranged at least partially, preferably substantially entirely, in the at least one compression region of the leg apparel.

It is also advantageous for the effectiveness of the proprioceptive stimulating effect of the stimulus-inducing structure if the stimulus-inducing structure, in the worn state of the leg apparel, is in direct contact with the skin of the wearer of the leg apparel.

Alternatively thereto, it can also be provided that, in the worn state of the leg apparel, at least one stimulus-inducing structure is separated from the skin of the wearer by a covering.

In particular it can be provided that at least one stimulus-inducing structure is covered by a textile construction.

Thus it is possible, particularly depending on the configuration of functional elements of the stimulus-inducing structure with regard to their hardness, height and pointedness, to allow these functional elements to act indirectly on the skin of the wearer of the leg apparel.

The compression region of the leg apparel preferably comprises an elastically yielding material.

In particular, it can be provided that the compression region of the leg apparel comprises a knitted fabric.

Preferably, the compression region of the leg apparel comprises at least one elastic yarn, for example, elastane.

The compression region can in principle have a compression strength which is substantially constant.

In a preferred embodiment of the invention, however, it is provided that the compression region has a gradual progression of the compression strength.

In particular, if the compression region is arranged in the leg region of the leg apparel, it is advantageous if the compression strength in the compression region decreases upwardly, in particular in the direction toward a border region of the leg apparel.

In principle, however, it could also be provided that the compression strength increases upwardly, in particular in the direction toward a border region of the leg apparel.

If the leg apparel comprises a knee region which, in the worn state of the leg apparel, covers the knee of the wearer, then the compression region preferably does not comprise the knee region of the leg apparel.

If the leg apparel comprises a region which, in the worn state, is arranged above the knee of the wearer of the leg apparel, in particular a thigh region, then it is advantageous if the compression strength in this region of the leg apparel decreases upwardly, that is, in the direction toward the trunk of the wearer of the leg apparel.

The maximum compression strength in the compression region is preferably at least approximately 7 mm Hg, particularly at least approximately 10 mm Hg.

Furthermore, it is favourable if the maximum compression strength in the compression region is preferably not more than approximately 32 mm Hg, particularly not more than approximately 25 mm Hg.

In preferred embodiments of the leg apparel according to the invention, at least one compression region comprises at least one part of a middle foot region, at least one part of an ankle region and/or at least one part of a leg region of the leg apparel.

The proprioceptive stimulating effect of the stimulus-inducing structure is preferably achieved in that the stimulus-inducing structure comprises at least one stimulus-inducing functional element.

In preferred embodiments of the invention, the stimulus-inducing structure has a multiplicity of such functional elements.

The different functional elements of the stimulus-inducing structure can be isolated from one another or, particularly at end regions of the functional elements, adjoin one another.

Preferably, at least one functional element of a stimulus-inducing structure is configured as a raised portion.

The functional elements can be formed by attaching or working in materials or constructions to a base element, in particular a basic knit material of the leg apparel, which result in a localised raised portion of the textile structure which is noticeable during wearing of the leg apparel as a local pressure point.

Preferably, the functional elements are fixedly attached directly to a textile material of the leg apparel. By this means the stimulus-inducing structure can be optimally positioned on the leg apparel.

In principle, all materials and designs which result in a local pressure point on the skin of the wearer of the leg apparel are suitable for the formation of the functional elements.

In principle, this can involve both hard, compact materials made, for example, of wood, plastics of any type or metal, as well as soft, flexible, plastic materials, such as plastics based on silicone, polytetrafluoroethylene (PTFE) or polyurethane (PUR).

In a preferred embodiment of the invention, it is provided that at least one functional element contains an elastic polymer, a thermoplastic polymer and/or a thermosetting polymer.

In particular, it can be provided that at least one functional element contains a silicone, a PVC-based plastisol, a polyurethane-based polymer, and/or a polyetetrafluorethylene-based polymer.

Alternatively or additionally thereto, it can also be provided that at least one functional element is formed by a textile construction, for example, plush, a spacer fabric, a spacer knitted fabric or by a punctiform two-layered or knitted fabric.

Alternatively or additionally thereto, it can also be provided that at least one functional element comprises a knitted region of the leg apparel which, with regard to its knitted construction, differs from a knitted region of the leg apparel adjoining the functional element.

It can be provided, for example, that the knitted region of the functional element is configured as a plush.

Alternatively thereto, it can be provided that the knitted region of the functional element is configured as a tuck stitch fabric.

In order to increase the mechanical strength and hardness of the functional element, it can be provided that the knitted region of the functional element contains a hot-melt adhesive thread.

A hot-melt adhesive thread of this type can comprise, for example, polyester and/or copolyamide, and can preferably be made substantially entirely of polyester and/or copolyamide.

The hot-melt adhesive material from which such a hot-melt adhesive thread is made can have, for example, a softening point of 50° C. or higher, in particular 80° C. or higher.

Following a knitting procedure, by means of which the respective functional element is created, the region of the leg apparel in which the functional element has been created can be subjected to a heat treatment, by means of which the hot-melt adhesive material is heated to a temperature above its softening point.

The treatment temperature can be 70° C. or higher, in particular 100° C. or higher.

The higher the treatment temperature is selected to be, the more intimately the hot-melt adhesive material is connected to the other materials of the functional element and the harder the functional element thereby produced becomes.

The heat treatment can be performed, for example, by tumbling, form fixing or the application of hot air.

At least one functional element, preferably a plurality of functional elements, have a drop-shaped or napped form.

It is particularly favourable for the proprioceptive stimulating effect if the functional elements exert a localised pressure loading onto the skin of the wearer.

It is therefore favourable if at least one functional element of a stimulus-inducing structure is configured locally delimited, in particular substantially punctiform.

Preferably, all the functional elements of at least one stimulus-inducing structure, in particular all the functional elements of all the stimulus-inducing structures of the leg apparel are configured locally delimited, in particular substantially punctiform.

It is particularly favourable if at least one functional element has a largest extent (along the base element of the leg apparel) of not more than approximately 1.0 cm, preferably not more than approximately 0.7 cm, in particular not more than approximately 0.6 cm, particularly preferably not more than approximately 0.3 cm. It is particularly favourable if all the functional elements of a stimulus-inducing structure have such a greatest extent.

It has also proved to be favourable if at least one functional element has a largest extent (along the base element of the leg apparel) of at least approximately 0.2 cm. It is particularly favourable if all the functional elements of a stimulus-inducing structure have such a greatest extent.

A functional element of a stimulus-inducing structure can have, for example, a substantially circular outer contour.

Each functional element, in particular each locally delimited functional element, however, can in principle also have any other outer contour, for example, a polygonal outer contour, a triangular outer contour, a square outer contour, a rectangular outer contour or an angular outer contour.

Locally delimited functional elements differ from linear elements which have a large extent in one dimension and from large area elements which have a large extent in two dimensions.

If functional elements of a stimulus-inducing structure which are particularly in the form of web elements, adjoin one another at their end regions and thus form a coherent stimulus-inducing structure, such a stimulus-inducing structure can be configured, in particular, honeycomb-shaped.

For a local, isolated proprioceptive stimulation of the musculature of the wearer, it is of essential significance that between the functional elements of a stimulus-inducing structure which are configured, in particular, punctiform or linear, area sections that are free from the functional elements remain on the leg apparel which, in the worn state of the stocking, exert no pressure on the skin of the wearer.

The height of at least one functional element, that is, its extent perpendicular to the base element of the leg apparel, by which the functional element projects toward the skin of the wearer, is at least approximately 0.1 cm, in particular at least approximately 0.2 cm.

It is also advantageous if the height of at least one functional element is not more than approximately 0.4 cm, in particular not more than approximately 0.3 cm.

It has also proved to be favourable if the Shore A hardness of the material of at least one functional element is at least approximately 20, preferably at least approximately 30.

Preferably at least one functional element is made of a material with a Shore A hardness of not more than approximately 90.

The Shore A hardness can be determined according to DIN 53505 or DIN EN ISO 868.

Alternatively or additionally thereto, it can also be provided that at least one functional element is made of a material with a Shore D hardness of at least approximately 20.

The Shore D hardness is preferably not more than approximately 90.

The Shore D hardness can be determined according to DIN 53505 or DIN ISO 7619-1.

In a particular embodiment of the invention, it is provided that at least one functional element is fixed to a base element of the leg apparel. Preferably, all the functional elements are fixed to the base element of the leg apparel.

In particular, it can be provided that at least one functional element is fixedly connected directly to a textile material of the garment. By this means, the stimulus-inducing structure formed by the functional elements can be optimally positioned on the leg apparel.

The application of functional elements which are not based on a textile construction onto the base element of the leg apparel can be carried out, for example, by a printing method, for example, a stencil printing method or a silk screen method with subsequent thermal fixing of the functional elements to the base element of the leg apparel.

Alternatively or in addition thereto, it can be provided that at least one stimulus-inducing structure comprises at least one support element on which a plurality of functional elements are provided.

In particular, it can be provided that the plurality of functional elements are formed integrally with the support element.

At least one support element can be non-releasably fastened to a base element of the leg apparel.

Alternatively or in addition thereto, it can be provided that at least one support element is releasably connected to a base element of the leg apparel.

A plurality of stimulus-inducing functional elements can be connected in a separate process to a coherent unit and this unit can be fixed to the base element of the leg apparel, for example, by adhesion, welding or sewing.

The support element can be a pre-fabricated part which has a plurality of functional elements.

The support element can be formed, for example, as an injection moulded part.

A stimulus-inducing structure can be formed by a support element of this type or by a plurality of such support elements.

The outer contour of such a support element can correspond to the outer contour of an overall stimulus-inducing structure.

The support element can be formed, for example, as a film or a textile construction.

A support element which preferably comprises the stimulus-inducing functional elements of an overall stimulus-inducing structure and is preferably based on a textile construction can be connected flexibly and/or releasably to the base element of the leg apparel by means of known manufacturing techniques.

The leg apparel can be provided with markings differentiated by colour relative to a base material of the leg apparel, which serve as an orientation aid for the wearer of the leg apparel when putting on the leg apparel, in order to achieve an optimum positioning of the stimulus-inducing structures on the body of the wearer.

The attachment of stimulus-inducing structures along the tibialis anterior muscle and tendon structure and/or the peroneal muscles and tendons has been found to be particularly favourable for an effective proprioceptive stimulation.

It is therefore advantageous if, in the worn state of the leg apparel, at least one stimulus-inducing structure at least partially overlaps the tibialis anterior muscle and tendon structure and/or the peroneal muscles and tendons, for example, the peroneus longus muscle and tendon structure, of the wearer of the leg apparel.

Alternatively or additionally thereto, it has also been found to be advantageous if, in the worn state of the leg apparel, at least one stimulus-inducing structure at least partially overlaps the musculus gastrocnemius muscle at the inward side of the lower leg. In particular, it can be provided that an outer contour of the relevant stimulus-inducing structure substantially corresponds to an outer contour of the musculus gastrocnemius muscle.

It can also be provided that, in the worn state of the leg apparel, at least one stimulus-inducing structure at least partially overlaps the musculus vastus medialis muscle and or the musculus vastus lateralis muscle. In particular, it can be provided that an outer contour of at least one stimulus-inducing structure substantially corresponds to an outer contour of the musculus vastus medialis muscle and/or an outer contour of the musculus vastus lateralis muscle.

For example, it can be provided that, in the knee region of the leg apparel, two stimulus-inducing structures are provided which, in the worn state of the leg apparel, are arranged on mutually opposing sides of the kneecap of the wearer of the leg apparel. In particular, it can be provided that a stimulus-inducing structure is arranged on the inward side of the knee region and an opposing stimulus-inducing structure is arranged on the outward side of the knee region.

At least one of these stimulus-inducing structures is preferably configured to be arcuate. In particular, it can be provided that both of these stimulus-inducing structures are configured to be arcuate.

The stimulation by means of these stimulus-inducing structures initiates the stabilisation of the knee joint of the wearer of the leg apparel.

Alternatively or additionally thereto, it can be provided that, in the worn state of the leg apparel, at least one stimulus-inducing structure at least partially overlaps the musculus gluteus medius muscle, the musculus gluteus minimus muscle and/or the tractus iliotibialis fascia structure. It is preferably provided that an outer contour of a stimulus-inducing structure of the leg apparel substantially corresponds to an outer contour of the musculus gluteus medius muscle, the musculus gluteus minimus muscle or the tractus iliotibialis facia structure.

A stimulus-inducing structure of this type is preferably arranged, in the worn state of the leg apparel, on the outward side of the thigh from the hip to just above the musculus vastus lateralis muscle in the knee region.

Alternatively or additionally thereto, it can also be provided that, in the worn state of the leg apparel, at least one stimulus-inducing structure at least partially overlaps the rectus femoris muscle. In particular, it can be provided that an outer contour of the stimulus-inducing structure substantially corresponds to an outer contour of the musculus rectus femoris muscle.

A stimulus-inducing structure of this type is preferably arranged, in the worn state of the leg apparel, on the front side of the thigh.

Alternatively or additionally thereto, it can also be provided that, in the worn state of the leg apparel, at least one stimulus-inducing structure at least partially overlaps the rear flexor muscles at the rear side of the thigh. In particular, it can be provided that an outer contour of the stimulus-inducing structure substantially corresponds to an outer contour of the rear flexor muscles of the thigh.

Alternatively or additionally thereto, it can also be provided that, in the worn state of the leg apparel, stimulus-inducing structures are arranged to the left and right of the Achilles tendon.

All the stimulus-inducing structures described above with regard to their positioning bring about a proprioceptive stimulation of the respective wholly or partially overlapped muscles or fibrous structures.

By means of the proprioceptive stimulation, an improved synchronisation of the muscles recruited for the walking or running movement is achieved.

In order to achieve a selective proprioceptive stimulation and to prevent potential faulty stimulation, it is favourable if the leg apparel has at least two stimulus-inducing structures which are separated from one another by a region without any stimulus-inducing structure.

In a preferred embodiment of the leg apparel according to the invention, it is provided that the stimulus induction zones in which the stimulus-inducing structures are arranged cover not more than half, preferably not more than a third, in particular not more than a quarter of the inner surface of the leg apparel facing the body of the wearer in the worn state of the leg apparel.

It is also favourable if at least one stimulus-inducing structure is arranged outside the border region of the leg apparel.

In order to make the position of the stimulus-inducing structures visible from the outside of the leg apparel, it can be provided that at least one stimulus-inducing structure is arranged in a stimulus induction zone which is edged at least partially by a bordering strip.

A bordering strip of this type can stand out from the base element, in particular, by means of a colour of the bordering strip contrasting with the colour of the base element of the leg apparel.

In order to prevent inaccuracy in the positioning of the stimulus-inducing structure when putting on the leg apparel, the leg apparel is preferably provided with a marking which, in the worn state of the leg apparel, extends substantially along a longitudinal central plane of the leg apparel which separates an inward side of the leg apparel from an outward side of the leg apparel.

Herein, the "inward side" of the leg apparel is the side of the leg apparel facing toward the respective other leg of the wearer when the leg apparel is worn.

Accordingly, the "outward side" of the leg apparel is the side of the leg apparel facing away from the respective other leg of the wearer when the leg apparel is worn.

At least one stimulus-inducing structure of the leg apparel according to the invention is preferably substantially in the form of a strip.

It can also be provided that such a strip-shaped stimulus-inducing structure has a width (that is, an extent perpendicular to its longitudinal extent) of not more than approximately 4 cm, in particular not more than approximately 2 cm.

The stimulus-inducing structure is preferably fixedly attached to a base element, in particular a ground fabric of the leg apparel.

The surface density of the functional elements within a stimulus-inducing structure of the leg apparel is preferably at least approximately 1 per $cm^2$, in particular at least approximately 4 per $cm^2$, particularly preferably at least approximately 8 per $cm^2$.

Furthermore, the surface density of the functional elements within a stimulus-inducing structure is preferably not more than approximately 25 per $cm^2$, in particular not more than approximately 16 per $cm^2$, particularly preferably not more than approximately 12 per $cm^2$.

By means of the above-mentioned preferred embodiments of the functional elements and the stimulus-inducing structure, both the efficiency of the stimulating effect and the wearing comfort for the wearer are taken into account.

Further features and advantages of the invention are the subject matter of the following description and of the illustration in the drawings of an exemplary embodiment.

The same or functionally equivalent elements are provided in all the drawings with the same reference signs.

DETAILED DESCRIPTION OF THE INVENTION

Figure 1:
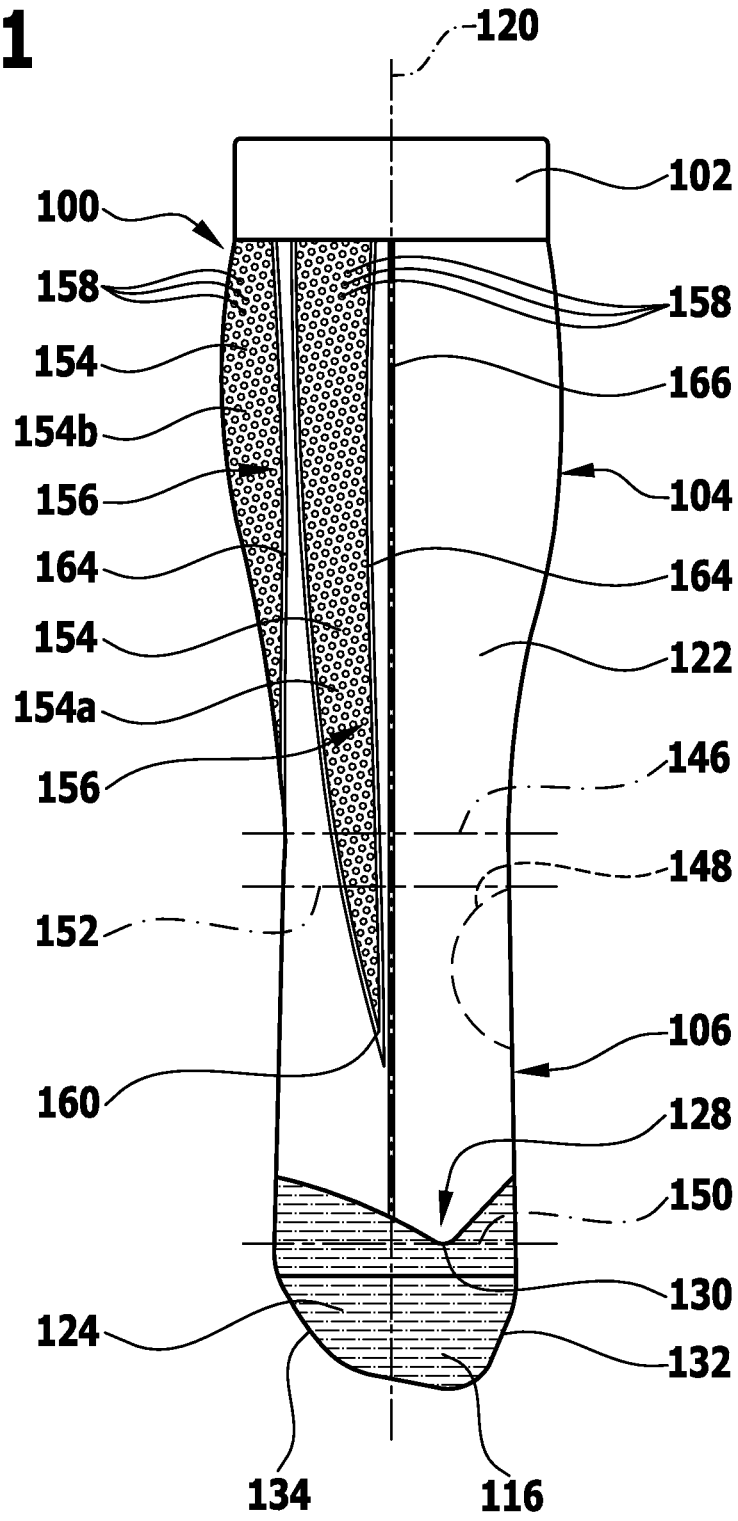
FIG. 1 shows a schematic front view of a right stocking with compression regions and stimulus induction zones.
Figure 2:
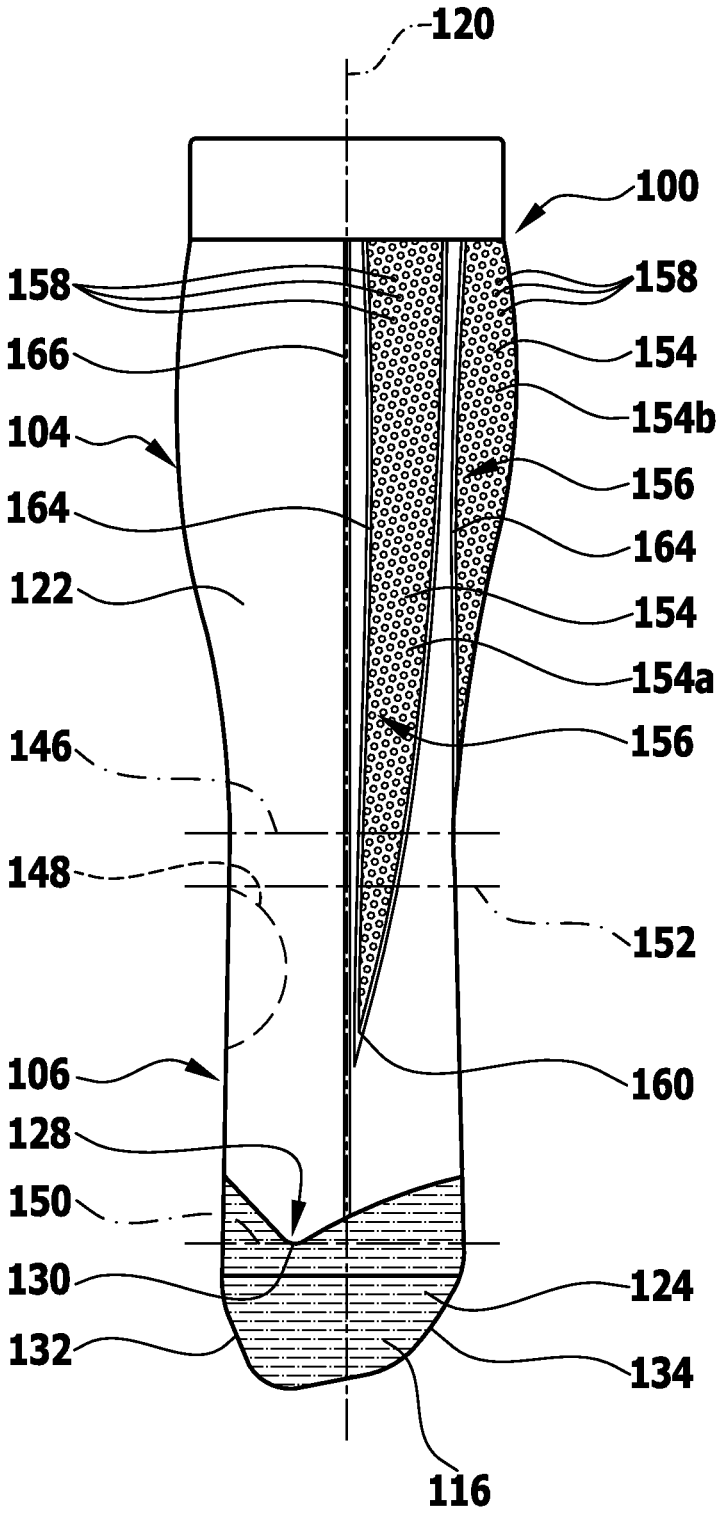
FIG. 2 shows a schematic front view of a left stocking with compression regions and stimulus induction zones.
Figure 3:
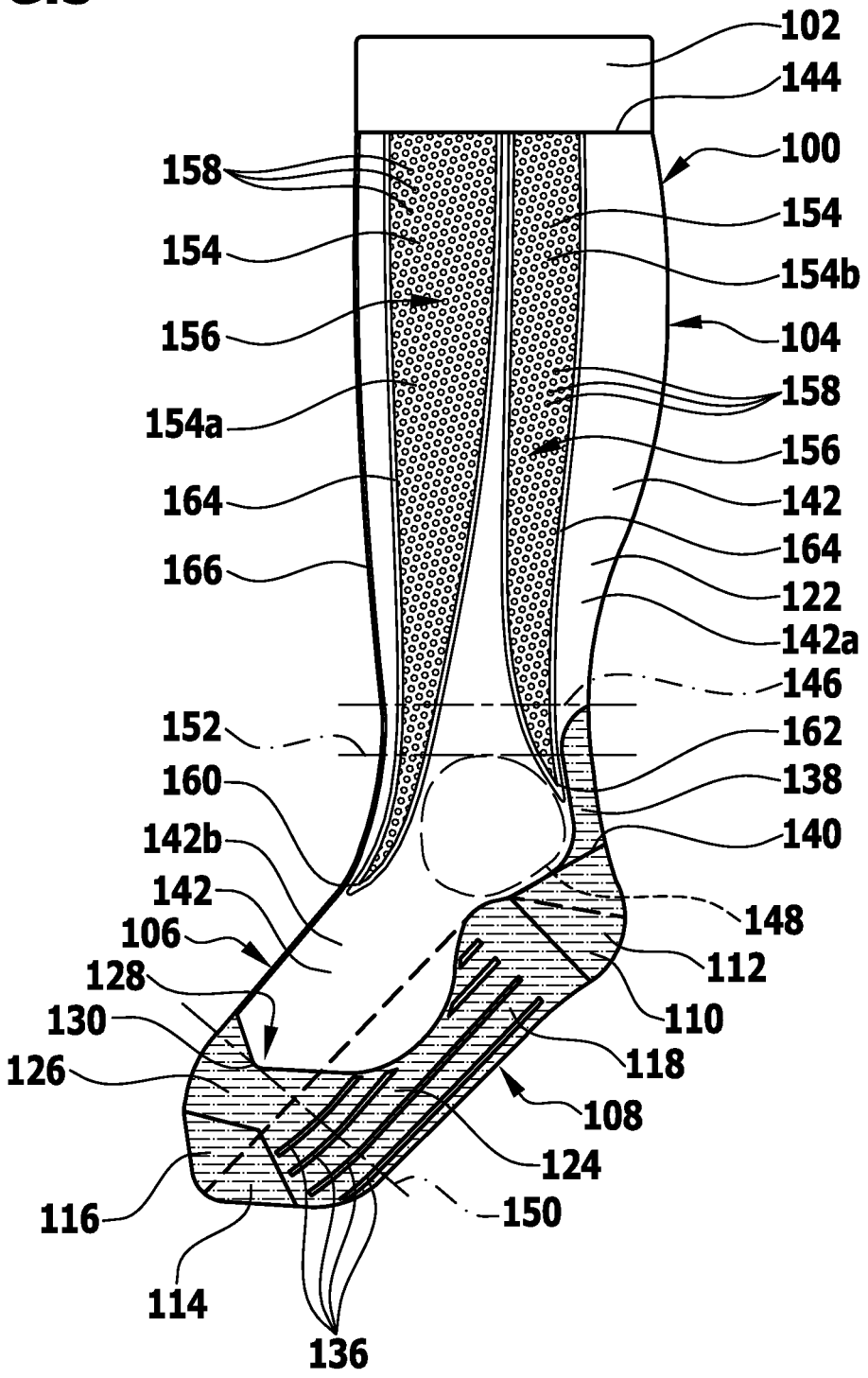
FIG. 3 shows a schematic side view of the left stocking of FIG. 2, with the viewing direction towards the left outward side of the stocking.

A stocking shown in FIG. 1 in a version for wearing on the right leg and in FIGS. 2 and 3 for wearing on the left leg, identified as a whole as 100 comprises a border region 102 at the upper end of the stocking, a leg region 104 adjoining the border region and a foot region 106 adjoining the leg region 104 downwardly and forwardly which, in the worn state, encloses the foot of the wearer.

The lower half of the foot region 106 of the stocking 100 forms a sole region 108 which encloses a lower half 110 of a heel region 112, a lower half 114 of a toe region 116 and an intermediate region 118 lying between the heel region 112 and the toe region 116.

The right stocking shown in FIG. 1 and the left stocking shown in FIGS. 2 and 3 are configured as mirror images of one another relative to a longitudinal central plane 120 of each stocking and form a stocking pair belonging together.

In order to be able to distinguish the stockings 100 of a stocking pair from one another, both stockings can be provided with a, preferably knitted-in, marking from which it can be seen whether the respective stocking is the left or the right stocking of the pair.

The side facing away from the other leg of the wearer when the stocking 100 is worn, is designated the "outward side" of the relevant stocking 100 in this description. The outward side of the left stocking is shown in FIG. 3.

The side facing toward the other leg of the wearer when the stocking 100 is worn, is designated the "inward side" of the stocking 100 in this description.

The outward side and the inward side of a stocking 100 are separated from one another by the longitudinal central plane 120 of the relevant stocking 100.

The side of the stocking 100 ("reverse side") facing toward the leg of the wearer when the stocking 100 is worn, is designated the "inside" of the relevant stocking 100 in this description. The side of the stocking 100 ("face side") facing away from the leg of the wearer when the stocking 100 is worn, is designated the "outside" of the relevant stocking 100 in this description.

The leg region 104 and the foot region 106 of the stocking 100 are made, preferably throughout, of a basic knit material 122 which comprises one or more ground threads. The ground thread or threads can be formed from any desired material, for example, a natural fibre or a synthetic fibre.

For the protection of the leg of the wearer against pressure or impact loading and/or for protection against heat loss, the stocking 100 can be provided with one or more paddings.

In particular, the foot region 106 of the stocking 100 can be provided with a foot padding 124 which extends from the toe region 116 via the intermediate region 118 of the sole region 108 to the heel region 112 and over an upper toe region 126.

As is best seen from FIGS. 1 and 2, this foot padding 124 is preferably configured asymmetrically in relation to the longitudinal central plane 120 of the foot region 106 of the stocking 100.

In particular, on the inward side of the stocking 100, a region of the foot region 106 which, in the worn state of the stocking 100, is arranged in the region of the inner foot arch of the wearer of the stocking 100 can be omitted from the foot padding 124. Since the wearer of the stocking 100 does not walk upon this region of the inward foot arch during walking, the outer contour of the foot padding 124 at the underside of the foot region 106 therefore substantially corresponds to the outer contour of the footprint of the wearer of the stocking 100.

On the upper side of the foot region 106, a wedge-shaped region 128 projecting toward the tip of the foot region 106 can be omitted from the foot padding 124.

This wedge-shaped omitted region 128 is preferably configured asymmetric relative to the longitudinal central plane 120 of the foot region 106; in particular, the forwardly-pointing tip 130 of this wedge-shaped omitted region 128 lies on the inward side of the stocking 100.

The toe region 116 provided with the foot padding 124 can also be configured asymmetric in relation to the longitudinal central plane 120 of the foot region 106 in order to enable better adaptation of the stocking 100 to the shape of the toes of the wearer of the stocking 100.

In particular, it can be provided that an inner edge section 132 of the toe region 116 arranged on the side of the big toe of the wearer is inclined at a smaller angle relative to the longitudinal central plane 120 of the foot region 106 than an outer edge section 134 of the toe region 116 arranged on the side of the little toe of the wearer.

A method for manufacturing an asymmetrical toe region 116 of this type is described in EP 1 049 828 B1.

Furthermore, a plurality of channels 136 extending substantially parallel to the longitudinal central plane 120 of the foot region 106 can be provided within the outer contour of the foot padding 124, in the region of which channels, the stocking 100 has a smaller degree of reinforcement than in the regions of the foot padding 124 surrounding the channels 136.

In particular, it can be provided that, in the region of the channels 136, the stocking 100 comprises only the basic knit material 122, but no additional reinforcing threads.

The foot padding 124 can comprise one or more reinforcing threads which can be formed from any desired material.

Preferably, it is provided that the reinforcing thread or threads of the foot padding 124 form plush loops which are preferably arranged on the "reverse side", that is on the inside of the stocking 100.

The stocking 100 can also comprise an Achilles tendon padding 138 which borders the foot padding 124 of the heel region 112 along an upper edge and from there extends upwardly.

The Achilles tendon padding 138 can also comprise one or more reinforcing threads which can be formed from any desired material.

Preferably, the reinforcement level of the Achilles tendon padding 138 corresponds to the reinforcement level of the foot padding 124.

The stocking 100 also has one or more compression regions 142 in which, in the worn state, the stocking 100 exerts a compression effect on the leg of the wearer.

This compression effect can be achieved, in particular, through the working in of one or more elastic threads into the basic knit material 122 of the stocking 100.

The elastic thread(s) can, in particular, comprise elastane.

In particular, the stocking 100 can comprise a first compression region 142*a* which extends from the upper edge 144 of the leg region 104 downwardly to a lower edge 146 of the first compression region 142*a*.

The lower edge 146 of the first compression region 142*a* preferably lies above an ankle area 148 of the stocking 100 which, in the worn state of the stocking 100, lies against the ankle of the wearer.

In particular, it can be provided that the lower edge 146 of the first compression region 142*a* extends at least approximately 1 cm, preferably at least approximately 2 cm above the ankle area 148.

Furthermore, the stocking 100 can have a second compression region 142*b* which extends from a front edge 150 in the middle foot region to a rear edge 152 in the region of the ankle joint of the wearer (in the worn state).

This second compression region 142*b* serves to stabilise and support both the foot arch and also the ankle joint of the wearer.

The toe region 116 is preferably not given any compression effect, for comfort reasons.

In the present exemplary embodiment, the lower edge 146 of the first compression region 142*a* and the rear edge 152 of the second compression region 142*b* are separated from one another.

It can, however, also be provided that the compression regions 142*a*, 142*b* directly adjoin one another and form a coherent compression region of the stocking 100.

The compression strength in the first compression region 142*a* and/or in the second compression region 142*b* is preferably at least approximately 10 mm Hg and/or not more than approximately 32 mm Hg, in particular not more than approximately 25 mm Hg.

The compression strength in the first compression region 142*a* and/or in the second compression region 142*b* can be constant across each compression region 142*a*, 142*b* or can have a gradient.

Thus, in particular, the first compression region 142*a* can have a compression variation wherein the compression strength decreases from below upwardly.

In particular, it can be provided that the compression strength at the upper edge 144 of the first compression region 142*a* is from approximately 60% to approximately 80% of the compression strength at the lower edge 146 of the first compression region 142*a*.

Furthermore, the stocking 100 comprises one or more stimulus induction zones 154 which are each provided with a stimulus-inducing structure 156.

Each stimulus-inducing structure 156 comprises functional elements 158 which, in the worn state of the stocking 100, bring about a sensory stimulus effect and a proprioceptive stimulation of the musculature of the wearer.

This stimulation leads to increased muscle activity and improves the synchronisation of the wearer.

The functional elements 158 are preferably configured as raised portions which are arranged on the inside of the stocking 100 and act directly on the skin of the wearer.

Particularly thermoplastic or thermosetting polymers, which can optionally contain additives, are suitable as a material for the raised portions.

Silicones and PVC-based plastisols have proved to be particularly suitable.

Functional elements 158 made of such materials can be applied, for example, by a printing method, in particular by a stencil printing method or a silk screen printing method, onto the inside of the basic knit material 122 of the stocking 100.

Alternatively or additionally, the functional elements 158 can be made particularly in the form of raised portions, but also with textile materials and/or textile constructions, which lead to the formation of a raised portion, for example by means of a plush configuration, projecting toward the skin of the wearer.

In order to achieve an effective proprioceptive stimulation of the musculature of the wearer, it is favourable if the stimulation takes place locally limited, in particular substantially in point form.

It is therefore favourable if the functional elements 158 have a largest extent of not more than approximately 0.7 cm.

On the other hand, it has proved to be favourable if the largest extent of the functional elements 158 is at least approximately 0.2 cm.

The height of the functional elements 158, that is, their extent perpendicularly to the basic knit material 122 by which the functional elements 158 project toward the skin of the wearer, is at least approximately 0.1 cm, in particular at least approximately 0.2 cm.

It has also proved to be favourable if the height of the functional elements 158 is not more than approximately 0.4 cm, in particular not more than approximately 0.3 cm.

Preferably, the functional elements 158 are made of a material with a Shore A hardness of at least approximately 30.

It has also proved to be favourable if the Shore A hardness of the material of the functional elements 158 is not more than approximately 90.

The Shore A hardness can be determined according to DIN 53505 or DIN EN ISO 868.

Alternatively, the functional elements 158 can be made of a material with a Shore D hardness of at least approximately 20 and/or not more than approximately 90.

The Shore D hardness can be determined according to DIN 53505 or DIN ISO 7619-1.

Since the stimulation effect of the stimulus induction zones 154 involves a proprioceptive stimulation of the muscle and tendon structures, the stimulus-inducing structures 156 are preferably arranged in stimulus induction zones 154 along the course of the muscles.

For example, the stocking 100 can have a front stimulus induction zone 154*a* which extends along the tibialis anterior muscle and tendon structure and/or a rear stimulus induction zone 154*b* which extends along the peroneus longus muscle and tendon structure.

The stimulus-inducing structure 156 of the front stimulus induction zone 154*a* for stimulation of the tibialis anterior muscle and tendon structure is arranged on the outward side of the stocking 100, beginning shortly below the knee of the wearer (in the worn state) and extends above the outer ankle of the wearer as far as the instep at most. The width of the front stimulus induction zone 154*a* decreases from top to bottom.

Preferably, the front stimulus induction zone 154*a* ends at a point 160 on the instep of the wearer.

The stimulus-inducing structure 156 of the rear stimulus induction zone 154*b* for stimulation of the peroneus longus muscle and tendon structure is also arranged on the outward side of the stocking 100 and is arranged behind and spaced apart from the front stimulus induction zone 154*a*. The rear stimulus induction zone 154*b* preferably begins shortly below the knee of the wearer (in the worn state), extends to the rear side of the ankle, and there ends at a point 162.

The width of the stimulus induction zones 154, that is, their extent in the peripheral direction of the stocking 100 is preferably dimensioned so that the individual anatomical differences of the different wearers are taken into account.

The width of the front stimulus induction zone 154*a* and/or the rear stimulus induction zone 154*b* is preferably at least approximately 2 cm and/or preferably not more than approximately 4 cm at their upper end.

Since the functional elements 158 of the stimulus induction zones 154 are arranged on the inside of the stocking 100, they do not have to be visible from the outside of the stocking 100 (as shown in FIGS. 1 to 3).

In order to make the position of the stimulus induction zones 154 visible from the outside of the stocking 100 in any event, it can be provided that the stimulus induction zones 154 are edged at least partially by a bordering strip 164.

This bordering strip 164 preferably stands out from the basic knit material 122 through a colour contrasting with the colour of the basic knit material 122.

In particular, it can be provided that the bordering strip 164 is formed by knitting one or more constrastingly-coloured threads into the basic knit material 122.

In order that the stimulus-inducing structures 156 of the stimulus induction zones 154 can have the strongest possible stimulating effect on the respective associated muscle and tendon structures, the stimulus induction zones 154 should be positioned, in the worn state, as precisely as possible on the respectively associated muscle and tendon structures.

In order to reduce as far as possible any inaccuracy in the positioning of the stimulus induction zones 154 through twisting of the leg region 104 when the stocking 100 is put on, the stocking 100 preferably has a marking strip or a marking line 166 which extends substantially centrally from the toe region 116 in a straight line to the border region 102 of the stocking 100, along the longitudinal central plane 120 of the stocking 100 and, when the stocking is put on 100, can serve as a positioning aid for the wearer.

This marking line 166 preferably stands out from the colour of the basic knit material 122 due to a contrasting colour.

In particular, it can be provided that the marking line 166 is formed by knitting one or more constrastingly-coloured threads into the basic knit material 122.

As shown in FIGS. 1 and 3, the stimulus-inducing structures 156 of the stimulus induction zones 154*a*, 154*b* are mostly arranged, preferably by more than 90%, in one of the compression regions 142 of the stocking 100. By this means, it is achieved that the local pressure loading of the skin of the wearer is amplified by the functional elements 158 of the stimulus-inducing structures 156 by the large area compression effect of the compression regions 142. Thus, by means of the combination of the compression effect, firstly, of the compression regions 142 and, secondly, of the local functional elements 158 of the stimulus-inducing structures 156, a particularly effective proprioceptive stimulation of the musculature of the wearer is brought about.

The surface density of the functional elements 158 in the stimulus induction zones 154 is preferably at least approximately 1 per $cm^2$, in particular at least approximately 4 per $cm^2$, particularly preferably at least approximately 8 per $cm^2$.

It has further proved to be favourable if the surface density of the functional elements 158 in the stimulus induction zones 154 is not more than approximately 25 per $cm^2$, in particular not more than approximately 16 per $cm^2$, particularly preferably not more than approximately 12 per $cm^2$.

In FIGS. 1 and 3, the functional elements 158 of the stimulus-inducing structures 156 are shown schematically as substantially circular.

Figure 4:
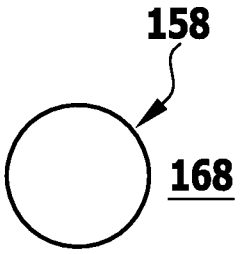
FIG. 4 shows a schematic representation of a punctiform or circular functional element of a stimulus-inducing structure.

A single functional element 158 with a circular edge is shown in FIG. 4.

Figure 5:
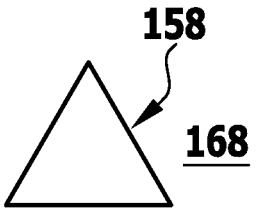
FIG. 5 shows a schematic plan view of a triangular functional element of a stimulus-inducing structure.
Figure 6:
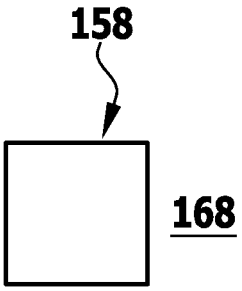
FIG. 6 shows a schematic plan view of a square functional element of a stimulus-inducing structure.
Figure 7:
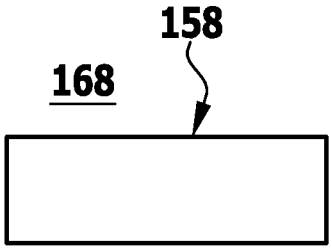
FIG. 7 shows a schematic plan view of a rectangular functional element of a stimulus-inducing structure.
Figure 8:
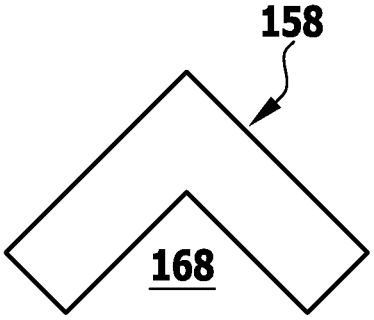
FIG. 8 shows a schematic plan view of an angular functional element of a stimulus-inducing structure.

The functional elements 158 can, in principle, also have any desired other outer contours, for example, a triangular outer contour (see FIG. 5), a square outer contour (see FIG. 6), a rectangular outer contour (see FIG. 7) or an angled outer contour (see FIG. 8).

Figure 9:
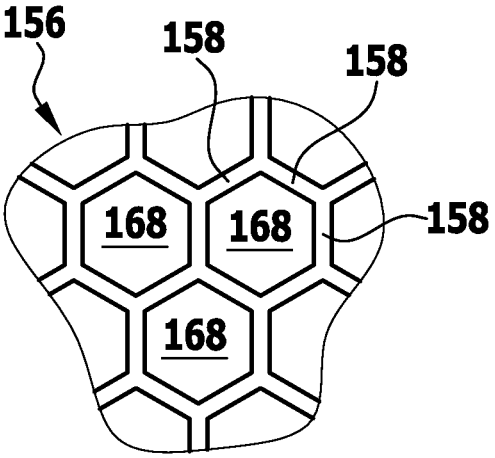
FIG. 9 shows a schematic plan view of a portion of a stimulus-inducing structure in the form of a honeycomb.

Furthermore, it can be provided that the functional elements 158 of a stimulus-inducing structure 156 are not entirely isolated from one another, but rather adjoin one another at end points and thus form a coherent stimulus-inducing structure 156, for example a stimulus-inducing structure 156 in the form of a honeycomb, as shown as a section in FIG. 9.

For a local, isolated proprioceptive stimulation of the musculature of the wearer, however, it is important that the functional elements 158 do not cover the whole area of the respective stimulus induction zone 154, but that surface sections 168 free from the functional elements 158 remain between the functional elements 158 and, in the worn state of the stocking 100, do not exert any pressure on the skin of the wearer.

In a leg apparel which comprises a textile base element 170 in the form of a basic knit material 172, the functional elements 158 of the stimulus-inducing structures 156 can be formed, in particular, in that the relevant functional element 158 comprises a knitted region 174 which differs in its knitted construction from an adjoining knitted region 176 of the basic knit material 172.

Figure 10:
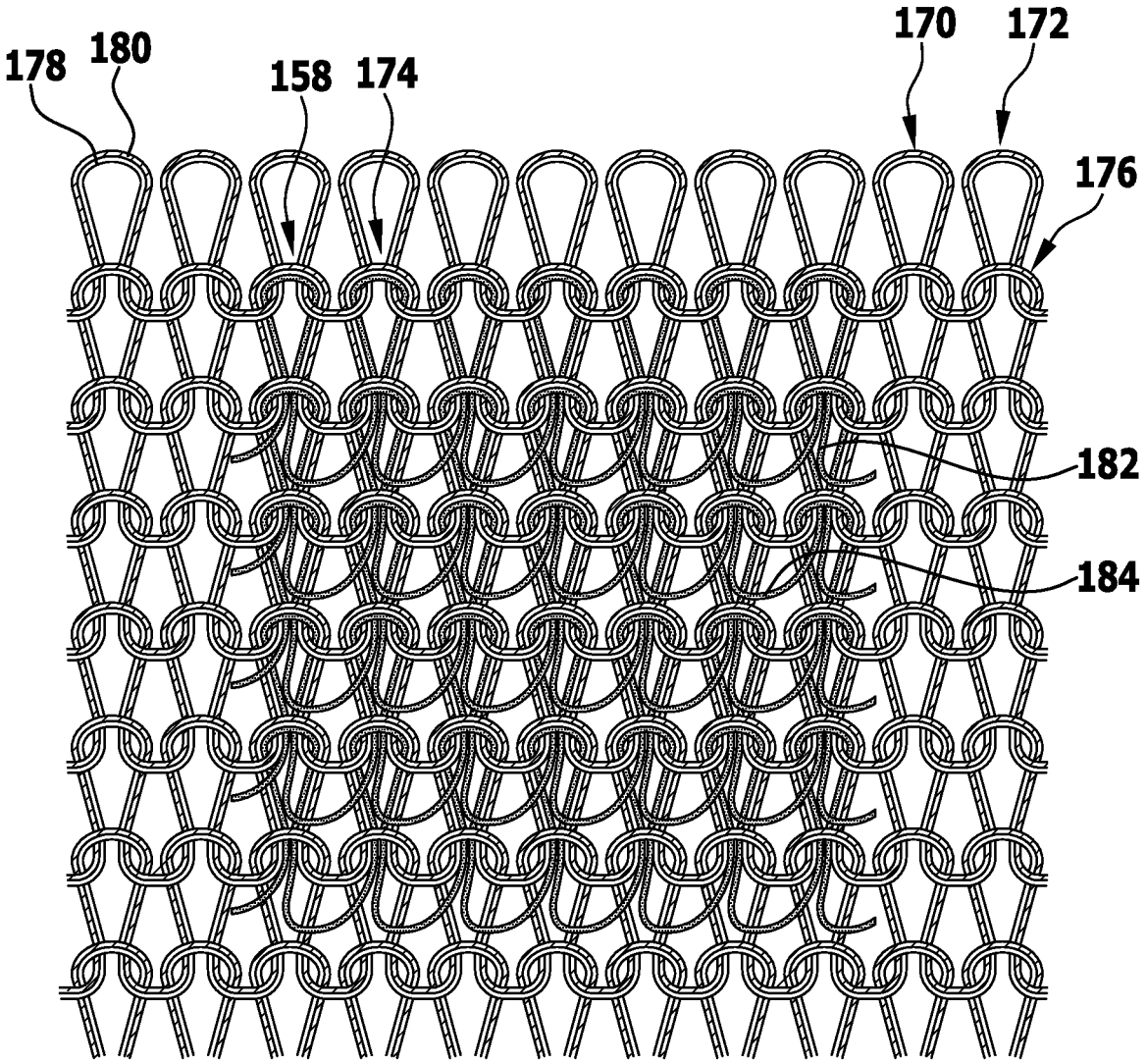
FIG. 10 shows a schematic stitch structure of a knitted surface with a knitted-in functional element in the form of plush.

Thus, in the functional element 158 shown schematically in its stitch structure in FIG. 10, the knitted region 176 of the basic knit material 172 adjoining the functional element 158 is knitted in a single jersey basic structure knitted from a ground thread 178 (shown in FIG. 10 without shading), which is plaited with a plaiting thread 180 (shown in FIG. 10 with shading).

In the knitted region 174 of the functional element 158 (shown centrally in FIG. 10) which in the exemplary embodiment shown comprises seven stitch wales and six stitch rows, an additional plush thread 182 (shown dotted in FIG. 10) is knitted into the basic knit material 172 with a plush weave.

The knitted region 174 of the functional element 158 is therefore selectively configured as a plush (sandwich or normal plush).

This plush forms a structure raised above the basic knit material 172.

The plush can be knitted with an ergonomic method (plated in shapes) or selectively knitted.

The shape of the knitted region 174 is, in principle, arbitrary; in particular, any of the outer contours shown in FIGS. 4 to 9 can be used for this.

Each functional element 158 which comprises a knitted region 174 with a raised area is knitted separately from the other functional elements 158 by means of the plush thread 182 introduced additionally from a basic system of the knitting machine or from one or more knitting systems of the knitting machine, which forms stitches together with the basic knit material 172.

Whilst the ground thread 178 and the plaiting thread 180 produce smooth stitches, ground stitches are created from the additional plush threads 182 with inwardly facing (that is, in the worn state of the leg apparel, toward the skin of the wearer) plush loops 184.

The additional plush thread 182 is introduced into an area which can be freely determined using a pattern and cut, for example, by means of a saw and a top blade of the knitting machine, so that individual functional elements 158 arranged separately from one another are produced.

Figure 11:
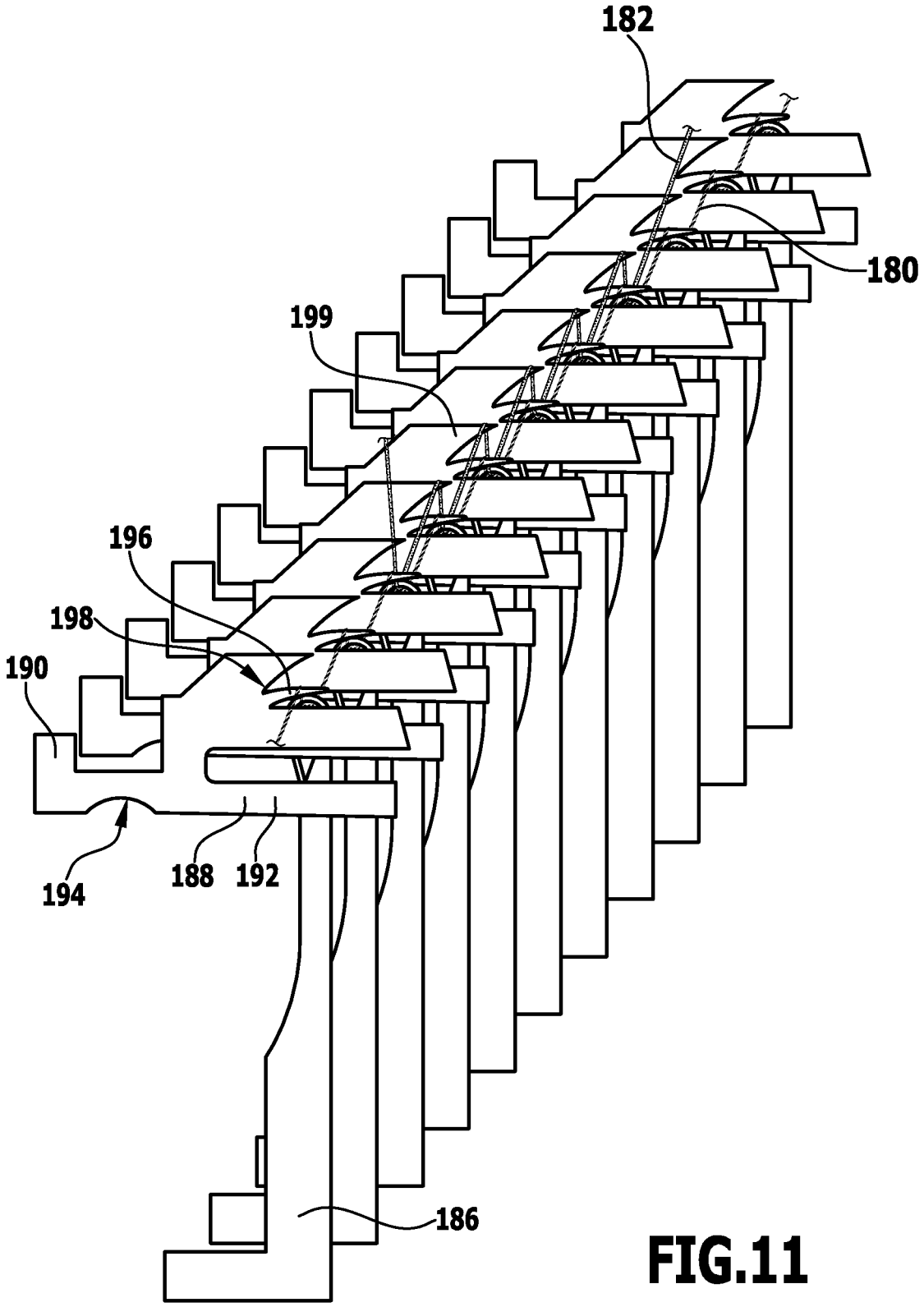
FIG. 11 shows a perspective view of sandwich plush sinkers of a knitting machine.

For manufacturing a selective plush or partial plush of this type, a knitting machine which has needles 186 and plush sinkers 188 can be used, as illustrated schematically in FIG. 11.

The plush sinkers 188 shown in FIG. 11 are sandwich plush sinkers. Alternatively thereto, however, other knocking-over sinkers, in particular, normal plush sinkers can be used.

Each of the plush sinkers 188 has a foot 190, a leg 192, a forward guide part 194 arranged between the leg 192 and the foot 190, a sinker beak 196 arranged above the leg 192, a throat 198 arranged above the sinker beak 196 and a plush nib 199 arranged above the throat 198.

The course of the plaiting thread 180 and of the plush thread 182 over the plush sinkers 188 and the needles 186 is also shown in FIG. 11. The ground thread 178 runs directly under the plaiting thread 180 and in the representation in FIG. 11 is covered by the plaiting thread 180.

Through the use of sandwich plush sinkers, the plush thread 182 is brought to the outside of the fabric.

Any desired materials and material combinations can be used as the ground thread 178 and the plaiting thread 180 of the basic knit material 172.

Preferably, for the formation of the plush in the knitted region 174 of the functional element 158, there is used a synthetic fibre material made, for example, of polypropylene in combination with a hot-melt adhesive material made, for example, of polyester.

In an actual exemplary embodiment, a polyproylene filament yarn (for example, a twisted dtex 84/F25/2 yarn, made of 2 threads of 25 filaments each) with a relatively low melting point in the region of 165° C. to approximately 175° C. and a softening point in the region of 150° C. to 155° C. is combined with the hot-melt adhesive material PES Grilon KE 60 with a softening point in the range of 55° C. to 65° C. and a usage temperature of 80° C. to 110° C.

The combination of these materials forming the plush thread 182 can be made, for example, by intermingling or entwining.

A twisting process is less favoured in order to obtain extensive neutrality in the twisting tendency.

The thread construction forming the plush thread 182 can be very readily used in the stitch forming process of the knitting process due to its retained softness.

Only by means of a subsequent heat treatment following the knitting process at a temperature in the range of approximately 105° C. to approximately 180° C. does melting of the materials take place in the knitted region 174 of the functional element 158, leading to the formation of stiffened, relatively hard structures which cause the stimulating effect when the leg apparel is worn.

The hardness of the functional elements 158 made in this way can be influenced, for example, by the selection of the treatment temperature during the heat treatment.

A higher treatment temperature leads, in principle, to a higher level of hardness of the functional elements 158, since a larger proportion of the hot-melt adhesive material is melted and binds to the other materials in the knitted region 174 of the functional element 158, so that the functional element 158 becomes stiffer.

The heat treatment can be performed after knitting the knitted region 174 of the functional element 158, for example, by tumbling, form fixing, or by applying hot air.

Figure 12:
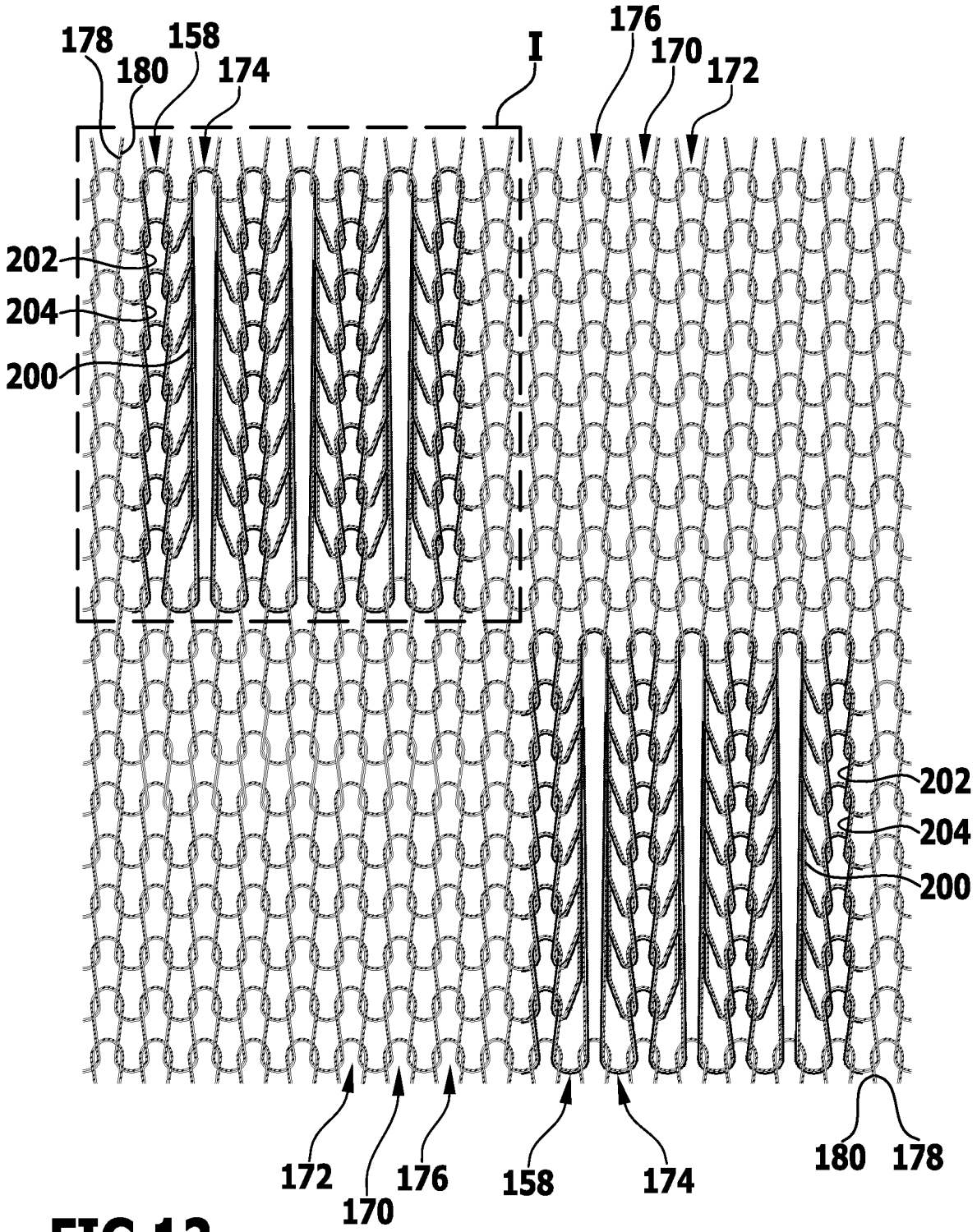
FIG. 12 shows a schematic stitch structure of a knitted surface with two functional elements configured as tuck stitch fabric.
Figure 13:
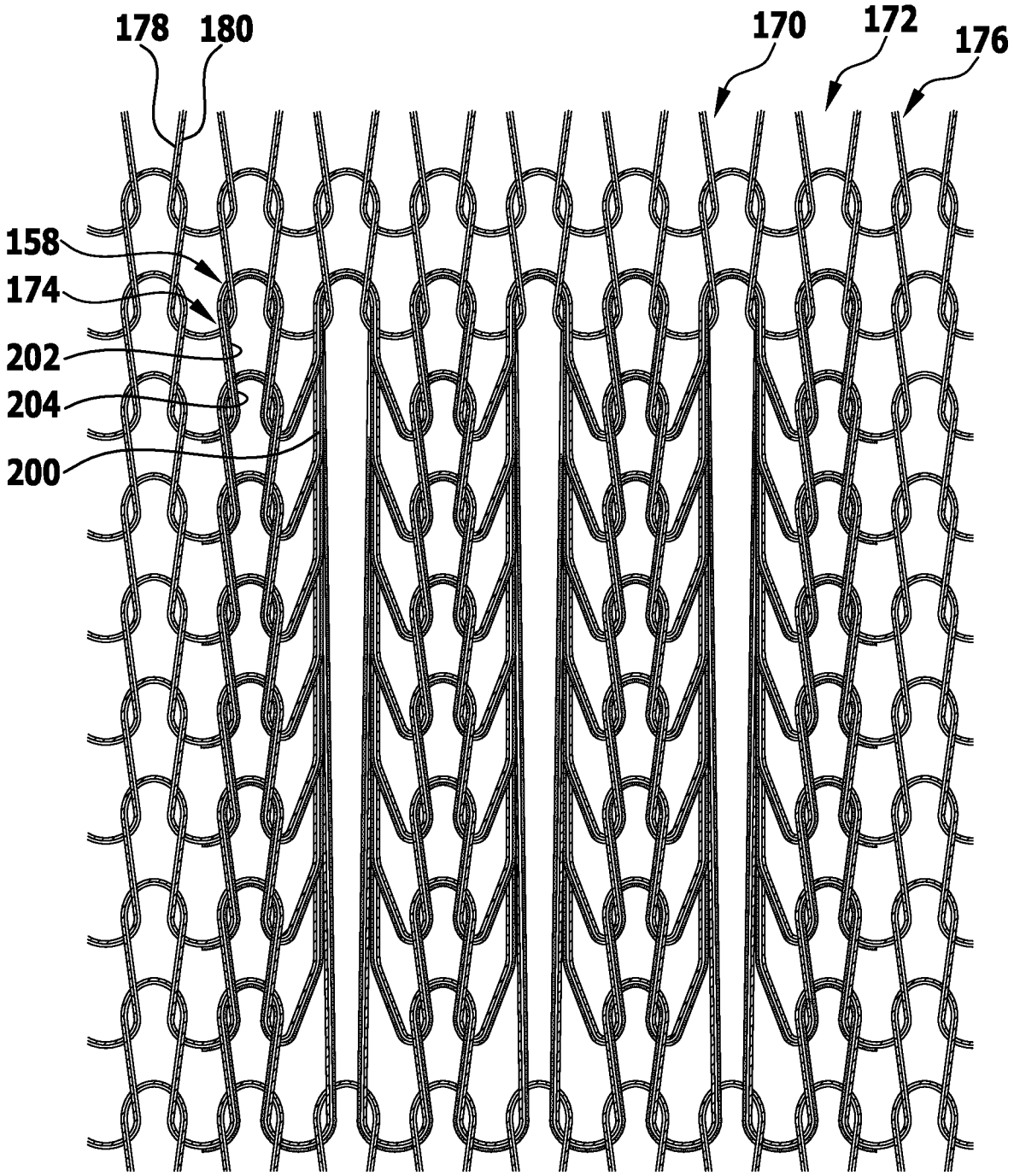
FIG. 13 shows an enlarged representation of the region I of FIG. 12.

Another possibility for creating functional elements 158 by generating a knitted region 174 which, with respect to its weave, differs from an adjoining knitted region 176 of a basic knit material 172 of the leg apparel is shown schematically in the stitch structures of FIGS. 12 and 13, wherein FIG. 13 is an enlarged section of the region I of the fabric, shown at top left in FIG. 12.

In this embodiment also, the basic knit material 172 is formed from a ground thread 178 (shown without shading in FIGS. 12 and 13) and a plaiting thread 180 (shown with shading in FIGS. 12 and 13).

A functional element 158 in the form of a region which is raised relative to the basic knit material 172 is obtained in this embodiment in that a tuck stitch fabric is created which comprises a plurality of tuck stitch loops 200 over a plurality of, in the exemplary embodiment shown eight, stitch rows and with a repeat of a plurality of, in the exemplary embodiment shown, six, stitch wales in a single jersey knitted fabric.

In the knitted region 174 of the functional element 158, a hot-melt adhesive thread 204 (shown dotted in FIGS. 12 and 13) can be worked in by plaiting as an additional plaiting thread 202.

A hot-melt adhesive thread 204 of this type can comprise, for example, polyester or copolyamide.

For example, the hot-melt adhesive material PES Grilon KE 60 made of polyester (with a softening point of 55° C. to 65° C.) or the hot-melt adhesive material Grilon KE 85 Copolyamide made of copolyamide with a softening point of 80° C. to 90° C. can be used as the hot-melt adhesive thread 204.

Any desired materials and material combinations can be used as the ground thread 178 and the plaiting thread 180 for the basic knit material 172.

In an actual exemplary embodiment, the elastic covering material CT 6416 consisting of an elastane thread with a fineness of dtex 17 covered with a polyamide thread having a dtex of 16F10 is used as the ground thread 178 and a polyamide yarn with a dtex of 78/68/2 is used as the plaiting thread 180.

When the knitted region 174 of the functional element 158 is knitted, the ground thread 178, the plaiting thread 180 and the hot-melt adhesive thread 204 are floated to form the tuck stitch loops 200 during the formation of a plurality of, for example eight, stitch rows and are then cast off.

This manner of manufacturing the functional elements 158 is suitable in particular for use with leggings, shorts or three-quarter length trousers and leg warmers.

In FIG. 12, two functional elements 158 made in this way are shown, offset to one another in a diagonal direction of the fabric.

Figure 14:
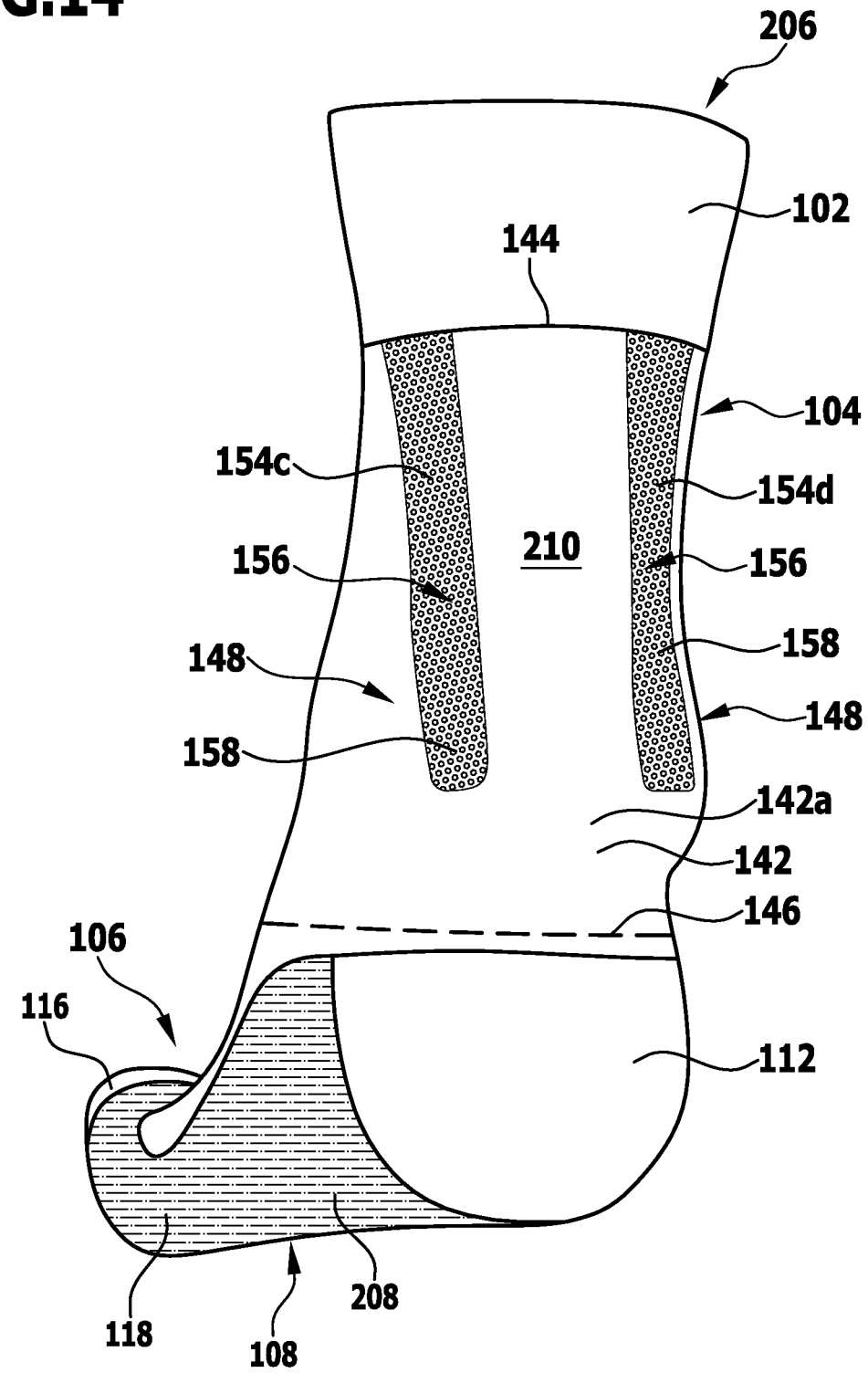
FIG. 14 shows a schematic perspective view of a sock with a padded sole region and stimulus-inducing structures on the left side and on the right side of an Achilles tendon of the wearer of the leg apparel.
Figure 15:
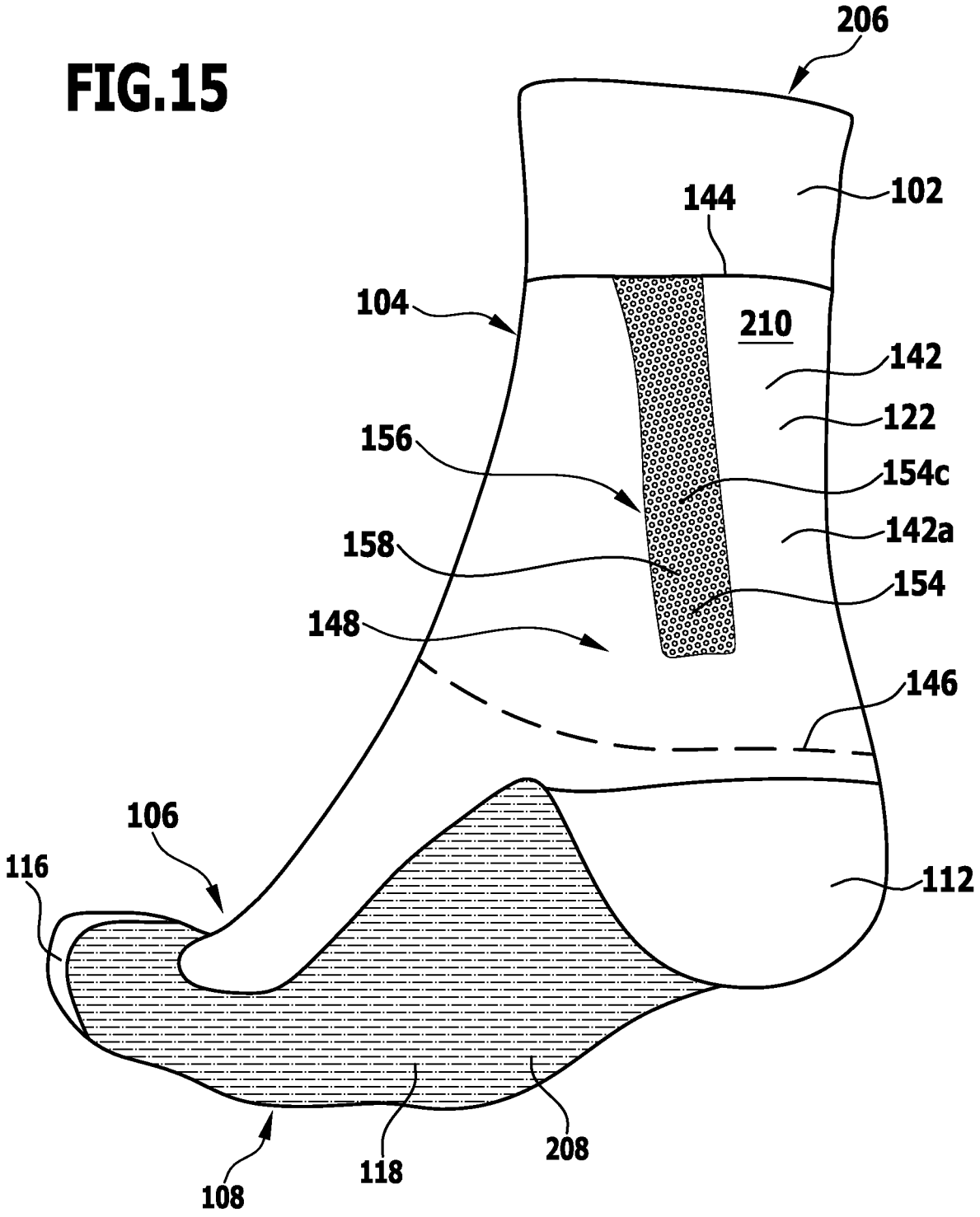
FIG. 15 shows a schematic side view of the sock of FIG. 14.

A second embodiment of a leg apparel with compression regions and stimulus induction zones is shown in FIGS. 14 and 15.

This leg apparel is a sock 206 with a border region 102 at the upper end of the sock 206, a leg region 104 adjoining the border region 102 downwardly and a foot region 106 adjoining the leg region 104 downwardly and forwardly which, in the worn state, encloses the foot of the wearer.

The lower half of the foot region 106 of the sock 206 forms a sole region 108 which encloses a lower half of a heel region 112, a lower half of a toe region 116 and an intermediate region 118 lying between the heel region 112 and the toe region 116.

The leg region 104 and the foot region 106 of the sock 206 are made, preferably throughout, of a basic knit material 122 which comprises one or more ground threads, and optionally one or more plaiting threads.

The ground thread or threads and the plaiting thread or threads can be formed from any desired material, for example, a natural fibre or a synthetic fibre.

For the protection of the leg of the wearer against pressure or impact loading and/or for protection against heat loss, the sock 206 can be provided with one or more paddings.

In particular, the foot region 106 of the sock 206 can be provided with a sole padding 208 which is arranged between the toe region 116 and the heel region 112.

The sock 206 also has one or more compression regions 142 in which, in the worn state, the sock 206 exerts a compression effect on the leg of the wearer.

This compression effect can be achieved, in particular, through the working in of one or more elastic threads into the basic knit material 122 of the sock 206.

The elastic thread(s) can, in particular, comprise elastane.

In particular, the sock 206 can comprise a first compression region 142*a* which extends from the upper edge 144 of the leg region 104 downwardly to a lower edge 146 of the first compression region 142*a*.

The lower edge 146 of the first compression region 142*a* preferably lies below an ankle area 148 of the sock 206 which, in the worn state of the sock 206, lies on the ankle of the wearer.

Apart from the compression region 142*a*, the sock 206 can have further compression regions, for example, in the middle foot region.

The toe region 116 is preferably not given any compression effect, for comfort reasons.

The compression strength in the first compression region 142*a* is preferably at least approximately 7 mm Hg and/or not more than approximately 25 mm Hg.

The compression strength in the compression region 142*a* can be substantially constant or can have a gradient.

Thus the compression region 142*a* can, in particular, have a compression variation wherein the compression strength decreases from the bottom upwardly.

In particular, it can be provided that the compression strength at the upper edge 144 of the compression region 142*a* is from approximately 60% to approximately 80% of the compression strength at the lower edge 146 of the compression region 142*a*.

Furthermore, the stocking 206 comprises one or more stimulus induction zones 154 which are each provided with a stimulus-inducing structure 156.

As in the first embodiment of a leg apparel shown in FIGS. 1 to 3, each stimulus-inducing structure 156 comprises functional elements 158 which, in the worn state of the sock 206, bring about a sensory stimulus effect and a proprioceptive stimulation of the musculature of the wearer.

These functional elements 158 can be configured and manufactured exactly as in the first embodiment and so reference is made in that regard to the above description of the first embodiment.

The sock 206 comprises, in particular, two stimulus induction zones 154*c* and 154*d*, the stimulus-inducing structures 156 of which are arranged, in the worn state of the sock 206, to the left and right, respectively, of the Achilles tendon of the wearer.

The stimulus induction zones 154*c* and 154*d* are therefore arranged on mutually opposing sides of an Achilles tendon region 210 of the sock.

Furthermore, the stimulus induction zones 154*c* and 154*d* and their stimulus-inducing structures 156 preferably run behind the respective associated ankle area 148 and do not cover the respective associated ankle area 148.

As in the first embodiment of a leg apparel, the functional elements 158 of the stimulus-inducing structures 156 are arranged on the inside of the sock 206, so that they can act directly on the skin of the wearer.

The functional elements 158 of the stimulus induction zones 154 therefore do not have to be visible from the outside of the sock 206 (as is the case in FIGS. 14 and 15 for reasons of simplified illustration).

Figure 16:
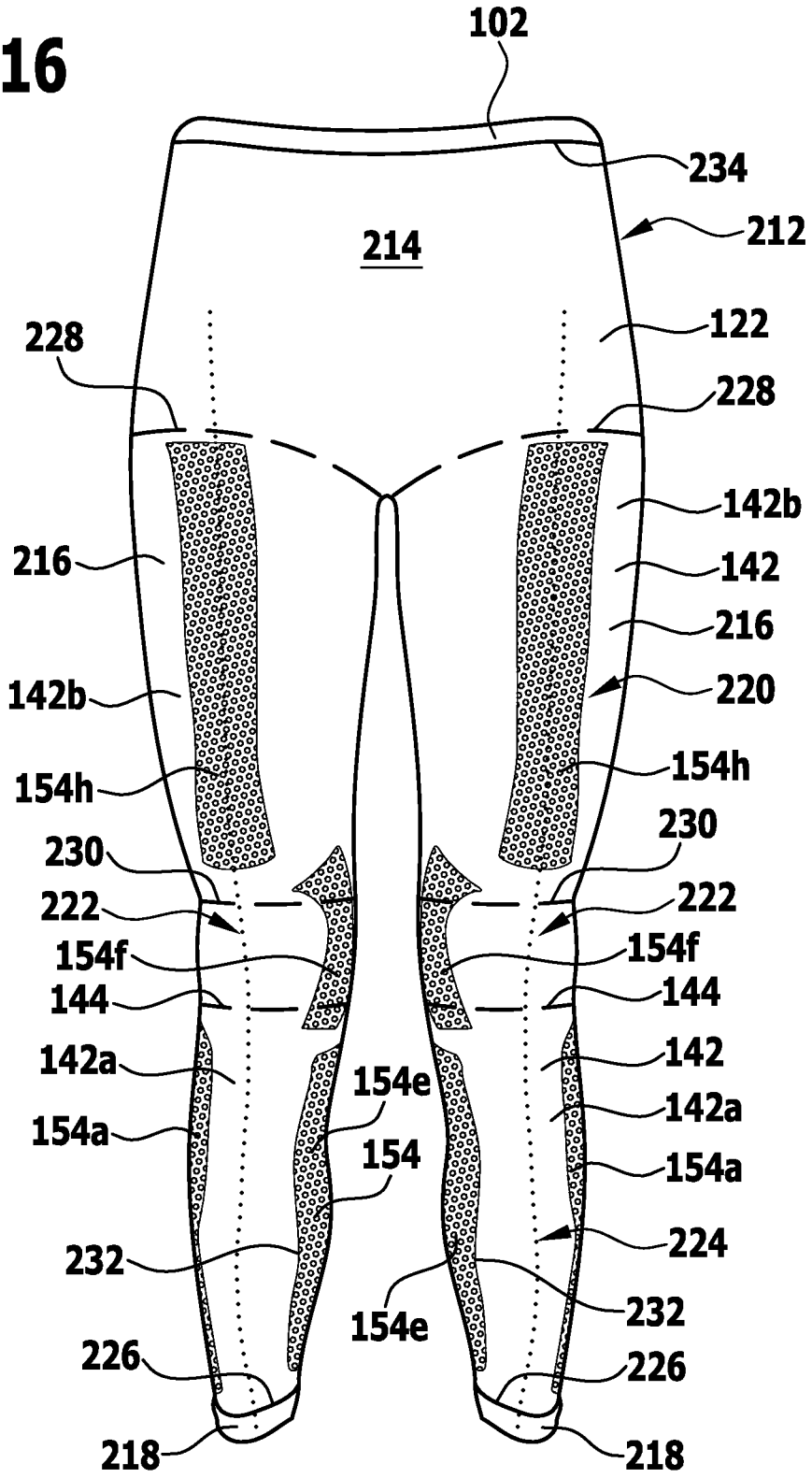
FIG. 16 shows a schematic front view of leggings with stimulus-inducing structures in the lower leg region, in the knee region and in the thigh region.
Figure 17:
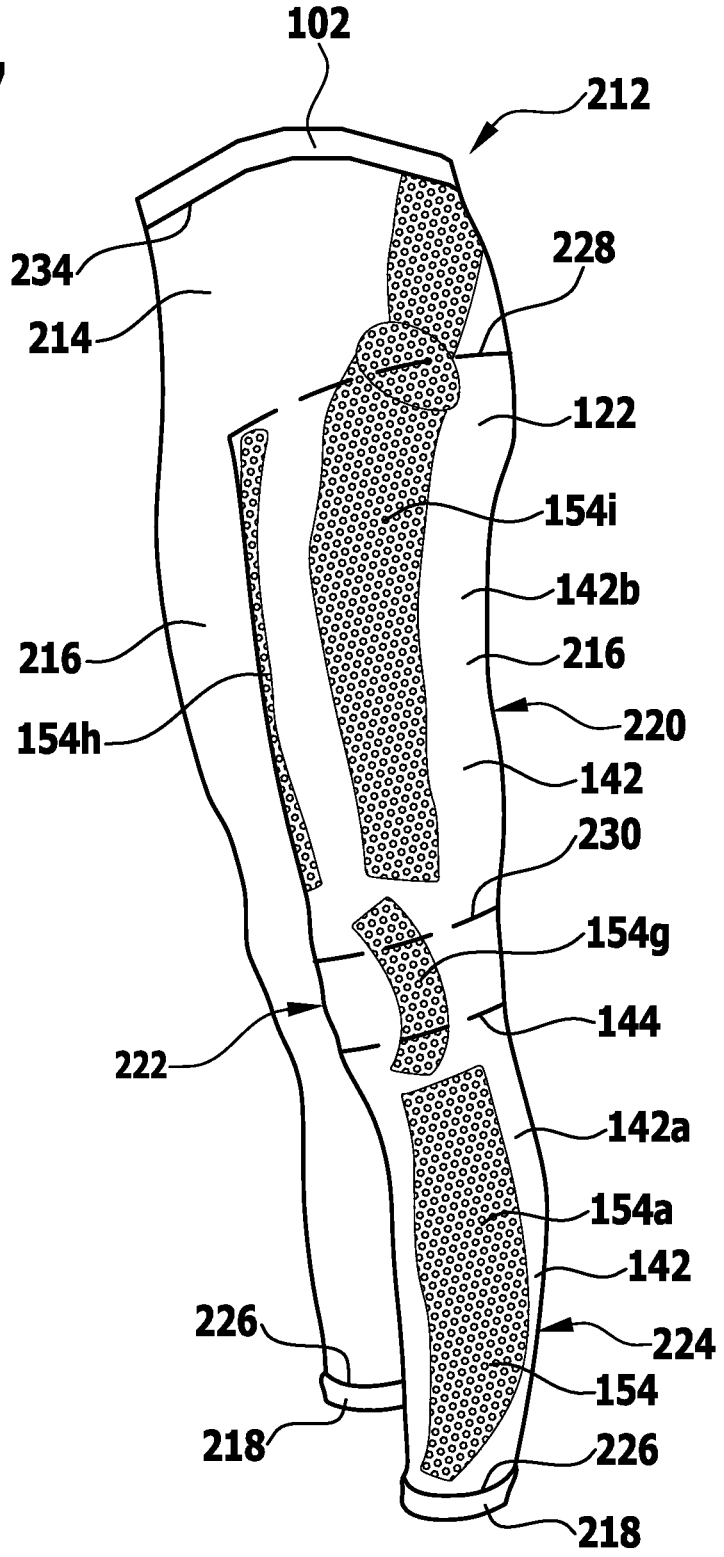
FIG. 17 shows a schematic side view of the leggings of FIG. 16 from the left.

A third embodiment of a leg apparel shown in FIGS. 16 and 17 differs from the first embodiment shown in FIGS. 1 to 3 in that the leg apparel is configured as leggings 212.

The leggings are shown from the front in FIG. 16 and from the left side in FIG. 17.

The leggings 212 comprise a border region 102 at the upper end, a trunk region 214 adjoining the border region 102 downwardly and two leg regions 216 extending downwardly from the trunk region 214 and each extending to a lower border region 218.

Each leg region 216 comprises a thigh region 220, a knee region 222 and a lower leg region 224.

The leggings 212 also have one or more compression regions 142 in which, in the worn state, the leggings 212 exert a compression effect on the body of the wearer.

This compression effect can be achieved, in particular, through the working in of one or more elastic threads into the basic knit material of the leggings 212.

The elastic thread(s) can, in particular, comprise elastane.

In particular, the leggings 212 can comprise, on each leg region 216, a first compression region 142*a* which extends from an upper edge 144 downwardly to an upper edge 228 of the respective lower border 226.

The upper edge 144 of the first compression region 142*a* preferably lies below the knee region 222 which, in the worn state of the leggings 212, lies against the knee of the wearer.

Furthermore, the leggings 212 can comprise, on each leg region 216, a second compression region 142*b* which extends from the upper edge 228 of each leg region 216 downwardly to a lower edge 230 of the second compression region 142*b*, which preferably extends above the respective knee region 222 of the leg region 216.

In the exemplary embodiments shown in FIGS. 16 and 17, the lower edge 230 of the second compression region 142*b* and the upper edge 144 of the first compression region 142*a* are spaced apart from one another.

It can, however, also be provided that the compression regions 142*a*, 142*b* directly adjoin one another and form a coherent compression region of the leggings 212.

The compression strength in the first compression region 142*a* and/or in the second compression region 142*b* is preferably at least approximately 7 mm Hg and/or not more than approximately 32 mm Hg.

The compression strength in the first compression region 142*a* and/or in the second compression region 142*b* can be constant across each compression region 142*a*, 142*b* or can have a gradient.

Thus, for example, the first compression region 142*a* and/or the second compression region 142*b* can have a compression variation wherein the compression strength decreases from the bottom upwardly.

In particular, it can be provided that the compression strength at the upper edge 144 of the first compression region 142*a* or at the upper edge 228 of the second compression region 142*b* is from approximately 60% to approximately 80% of the compression strength at the lower edge 226 of the first compression region 142*a* or at the lower edge 230 of the second compression region 142*b*.

Furthermore, the leggings 212 comprise one or more stimulus induction zones 154 which are each provided with a stimulus-inducing structure 156.

Each stimulus-inducing structure 156 comprises functional elements 158 which, in the worn state of the leggings 212, bring about a sensory stimulus effect and a proprioceptive stimulation of the musculature of the wearer.

These functional elements 158 can be configured and manufactured exactly as in the above-described first embodiment of a leg apparel.

In particular, the functional elements 158 are preferably configured as raised portions arranged on the inside of the leggings 212, so that they can act directly on the skin of the wearer.

For example, the leggings 212 can have stimulus induction zones 154*a* at the lower leg regions 224 of the leg regions 216, said stimulus induction zones extending on the outward side of the lower leg along the tibialis anterior muscle and tendon structure and/or along the peroneus longus muscle and tendon structure.

Alternatively or additionally thereto, the leggings 212 can have stimulus induction zones 154*e* in the lower leg regions 224 of the leg regions 226 which, in the worn state of the leg apparel, at least partially overlap the musculus gastrocnemius muscle on the inward side of the lower leg.

It is preferably provided therein that an outer contour 232 of the stimulus induction zone 154*e* substantially matches an outer contour of the musculus gastrocnemius muscle.

Alternatively or additionally thereto, the leggings 212 can have stimulus induction zones 154*f* and 154*g* in the knee region 222 of the leg regions 226, said stimulus induction zones being arranged, in the worn state of the leg apparel, on the inward side (facing toward the respective other leg of the wearer) or on the outward side (facing away from the respective other leg of the wearer) of the kneecap of the wearer and being preferably formed to be substantially arcuate.

In FIG. 16, the arrangement of stimulus induction zones 154*f* on the inward side of each knee region 222 is shown. In FIG. 17, the arrangement of a stimulus induction zone 154*g* on the outward side of a knee region 222 is shown.

It is preferably herein provided that, in the worn state of the leg apparel, the stimulus induction zones 154*f* and/or 154*g* at least partially overlap the musculus vastus medialis muscle and or the musculus vastus lateralis muscle.

In particular, it is provided that an outer contour 232 of the stimulus induction zones 154*f* and/or 154*g* substantially corresponds to an outer contour of the musculus vastus medialis muscle and/or an outer contour of the musculus vastus lateralis muscle.

Alternatively or additionally thereto, the leggings 212 can be provided on the front sides of the thigh regions 220 of the leg regions 216 with stimulus induction zones 154*h* which, in the worn state of the leg apparel, at least partially overlap the musculus rectus femoris muscle.

In particular, it can be provided that an outer contour 232 of the stimulus induction zones 154*h* substantially corresponds to an outer contour of the musculus rectus femoris muscle.

As is best shown by FIG. 17, the leggings 212 can also have stimulus induction zones 154*i* which extend downwardly from a lower edge 234 of the border 102 over one side of the trunk region 214 and, in the thigh region 220 of the respective leg region 216, extend on the outward side of the thigh from the hip to just above the stimulus induction zones 154*g* at the outward side of the knee region 222.

The positioning of the stimulus induction zones 154*i* is herein carried out so that the stimulus induction zones 154*i* overlap the musculus gluteus medius muscle, the gluteus minimus muscle and/or the tractus iliotibialis fascia structure, in particular substantially completely.

Alternatively or additionally thereto, the leggings 212 can comprise further stimulus induction zones (not shown) on the rear side of the thigh regions 220 of the leg regions 216 which, in the worn state, cover the rear flexor muscles, preferably substantially completely.

The above-described stimulus induction zones 154 bring about a proprioceptive stimulation of the respectively named muscles and fibre structures.

By means of the proprioceptive stimulation, an improved synchronisation of the muscles recruited for the walking or running movement is achieved.

Otherwise, the third embodiment of a leg apparel shown in FIGS. 16 and 17 coincides, with regard to structure, function and method of production, with the first embodiment shown in FIGS. 1 to 3, to the above description of which reference is therefore made.

A variety of possibilities as to how the functional elements 158 of the stimulus-inducing structures 156 in the stimulus induction zones 154 of a leg apparel can be produced directly on a base element 170 of the leg apparel have been described above.

Figure 18:
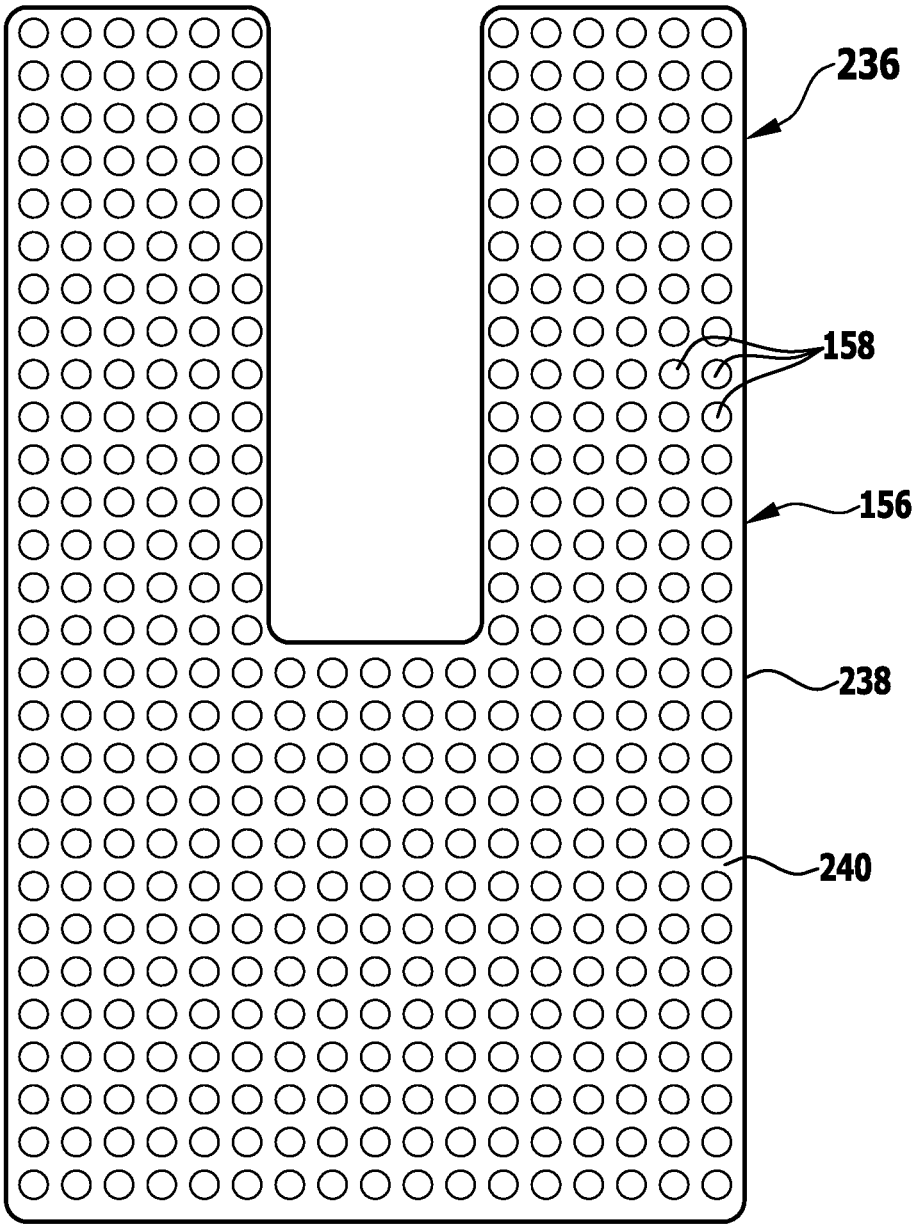
FIG. 18 shows a schematic plan view of a front side of a support element of a stimulus-inducing structure which is provided with a plurality of stimulus-inducing functional elements.
Figure 19:
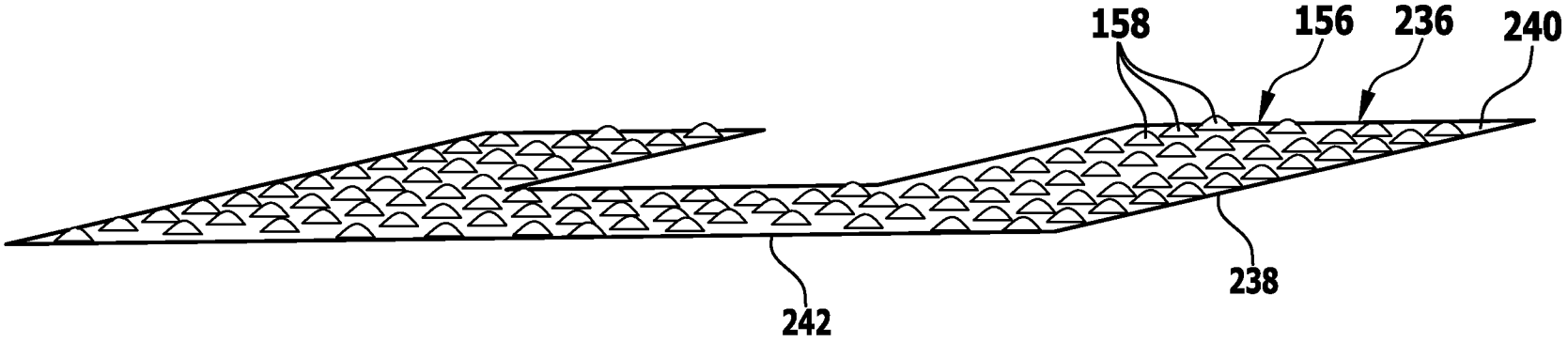
FIG. 19 shows a schematic perspective view of the support element of FIG. 18, with the viewing direction from obliquely above.

Alternatively thereto, in each of the leg apparels described above, at least one stimulus-inducing structure 156 can comprise at least one support element 236 (see FIG. 18) on which a plurality of functional elements 158 are provided.

The support element 236 having the functional elements 158 can be manufactured separately from the base element 170 of the leg apparel and then releasably or non-releasably connected to the base element 170 of the leg apparel.

In a particular embodiment of such a support element 236, it is provided that all the functional elements 158 of a stimulus induction zone 154 are arranged on the relevant support element 236, so that for manufacturing the stimulus-inducing structure 156 of the respective stimulus induction zone 154, only a single support element 158 is needed.

In such a case, an outer contour 238 of the support element 236 preferably substantially matches the outer contour 232 of the associated stimulus induction zone 154.

The outer contour 238 shown in FIGS. 18 to 21 is purely exemplary and can be replaced, in particular, by any other outer contour which corresponds to the outer contour 232 of any desired stimulus induction zone 154.

A support element of this type can be manufactured, for example, as an injection moulded part or as a film of a suitable plastics material.

Alternatively thereto, the support element 236 can comprise a textile material, for example a knitted fabric.

The support element 236 is arranged on the base element 170 of the leg apparel such that the stimulus-inducing functional elements 158 lie on a front side 240 of the support element 236 facing away from the base element 170 of the leg apparel and, in the worn state of the leg apparel, face toward the body of the wearer.

Figure 20:
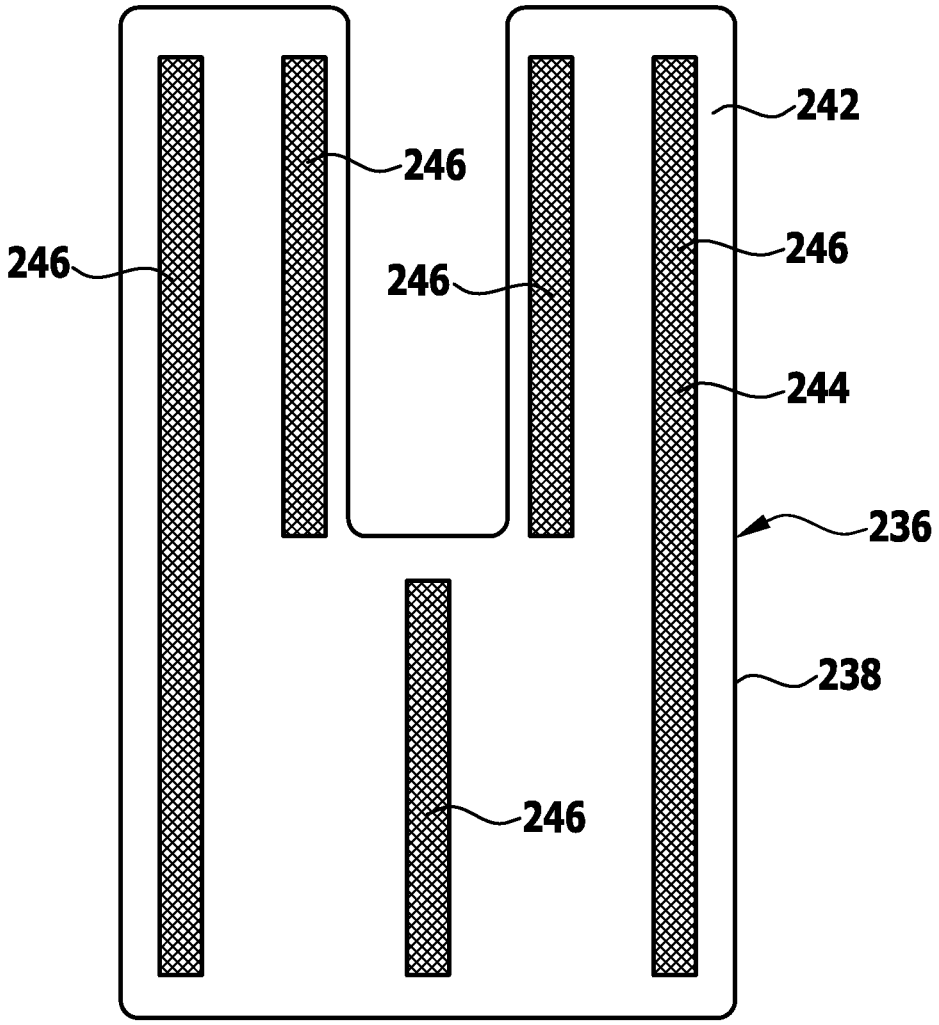
FIG. 20 shows a schematic plan view of a rear side of a support element facing away from the stimulus-inducing functional elements, the support element being provided with adhesive elements for releasable connection to a base element of a leg apparel.

The rear side 242 of the support element 236 shown in FIG. 20 which, in the mounted state of the support element 236, faces toward the base element 170 of the leg apparel can be provided with fastening devices 244. The fastening devices 244 can be configured, for example, as adhesion elements 246 which cooperate with adhesion elements (not shown) on the base element 170 of the leg apparel in order to fasten the support element 236 releasably on the base element 170 of the leg apparel.

In particular, the adhesion elements 246 can form a constituent part of a touch-and-close fastener or a hook-and-loop fastener.

Figure 21:
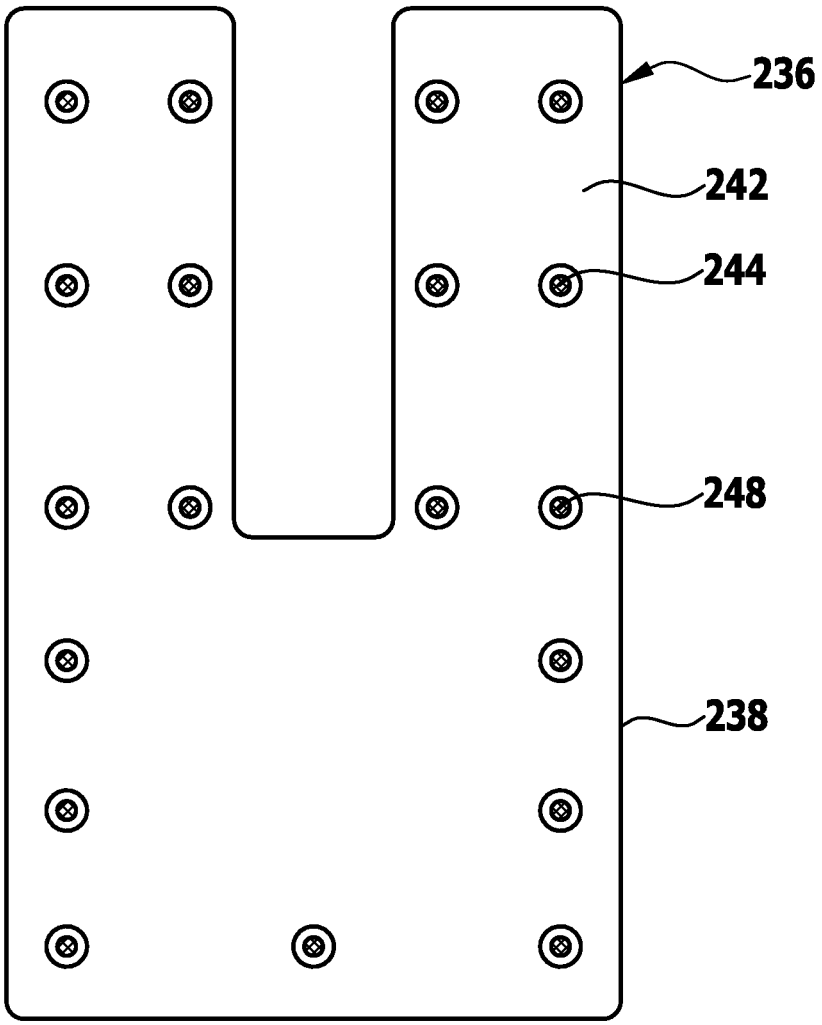
FIG. 21 shows a schematic plan view of a rear side of a support element facing away from the stimulus-inducing functional elements, the support element being provided with press fasteners for releasable connection to a base element of the leg apparel.

In an alternative embodiment of a support element 236, illustrated in FIG. 21, which is releasably fastenable to the base element 170 of the leg apparel, the fastening devices 244 are configured as locking elements 248 which are lockable to base element-side locking elements (not shown), in order to fasten the support element 236 releasably on the base element 170 of the leg apparel.

In particular, it can be provided that at least one support element-side locking element 248 and a base element-side locking element cooperating therewith together form a press fastener.

Figure 22:
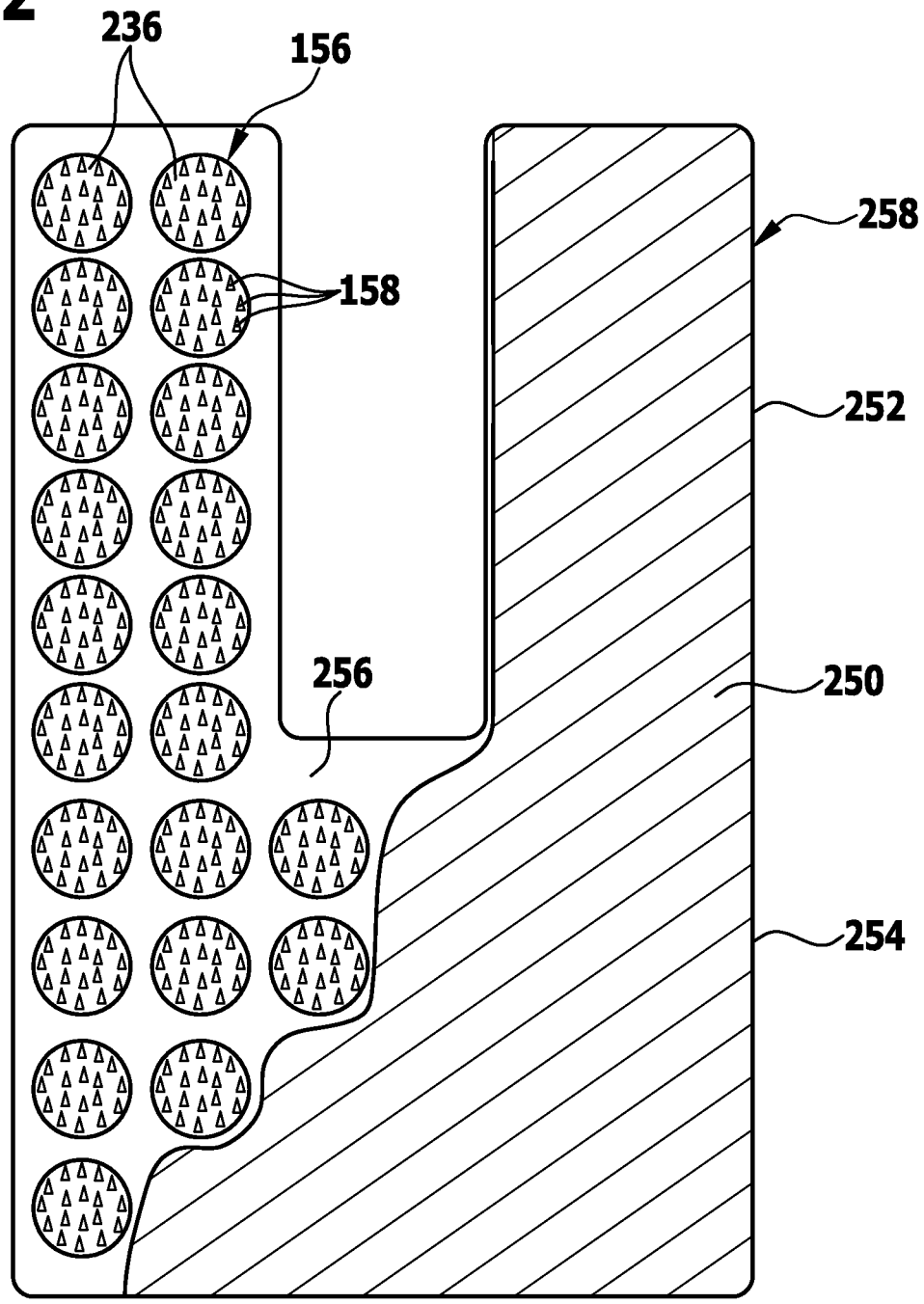
FIG. 22 shows a schematic plan view of a pocket which contains a plurality of support elements, each of which comprises a plurality of stimulus-inducing functional elements, wherein part of a front side of the pocket facing the skin of the wearer in the worn state of the leg apparel is broken away to show the support elements with the stimulus-inducing functional elements.
Figure 23:
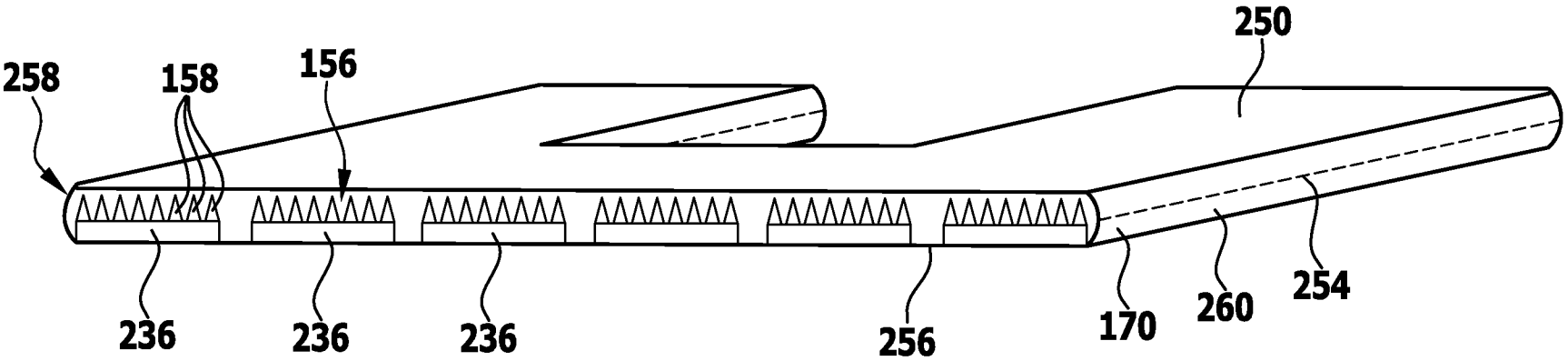
FIG. 23 shows a schematic perspective, partially sectional, view of the pocket with the support elements of FIG. 22.

In an alternative embodiment of the stimulus-inducing structure 156 of a stimulus induction zone 154 shown in FIGS. 22 and 23, it is provided that, in the worn state of the leg apparel, the functional elements 158 do not make direct contact with the skin of the wearer of the leg apparel, but rather that, in the worn state of the leg apparel, a covering 250 is arranged between the functional elements 158 and the body of the wearer.

The covering 250 can be formed, for example, from a textile material or a film, in particular a plastics film.

An outer contour 252 of the covering 250 preferably substantially matches the outer contour 232 of the respective stimulus induction zone 154.

As can be best seen from FIG. 23, the covering 250 can be connected, for example, by means of a seam 254, to a rear wall 256 manufactured separately from the base element 170, for example from a textile material or a film, in particular a plastics material and, together with the rear wall 256, can thus form a pocket 258 in which the functional elements 158 of the stimulus-inducing structure 156 are accommodated.

The pocket 258 is assembled from the covering 250 and the rear wall 256 separately from the base element 170 before the pocket 258 as a whole is non-releasably or releasably fastened to the base element 170 of the leg apparel.

The pocket 258 can be closed along its outer contour or can have an opening through which the functional elements 158 and, in particular, the support elements 236 supporting the functional elements 158 can be introduced into the pocket 258.

It can herein be provided that all the functional elements 158 of the stimulus-inducing structure 156 are arranged on a single support element 236.

In the embodiment shown in FIGS. 22 and 23, it is alternatively provided that the stimulus-inducing structure 156 has a plurality of support elements 236, each of which carries a plurality of stimulus-inducing functional elements 158.

The support elements 236 can be manufactured separately from the covering 250 and separately from the rear wall 256 and subsequently connected to the rear wall 256 and/or to the covering 250, for example, by adhesion, welding and/or sewing.

Furthermore, it could also be provided that the rear side of the pocket 258 opposing the covering 250 is not formed by means of a rear wall 256 configured separately from the base element 170, but rather by means of a section 260 of the base element 170.

Furthermore, it can be provided that arranged in the pocket 258 is a biasing element (not shown) which, in the worn state of the leg apparel, biases the functional elements 158 toward the body of the wearer, in order thus to amplify the application pressure of the functional elements 158 onto the skin of the wearer through the covering 250.

A biasing element of this type can comprise, for example, a foam material inlay.

The use of such a biasing element can be useful, in particular, if the body of the wearer of the leg apparel is concavely shaped in the region in which the relevant stimulus induction zone 154 is arranged.

The use of a covering 250 between the functional elements 158 and the body of the wearer of the leg apparel is particularly advantageous if the functional elements 158 are configured relatively hard, relatively high and/or relatively pointed.

The invention claimed is:

1. Leg apparel, which comprises at least one compression region in which, in a worn state, the leg apparel exerts a compression effect on a leg of a wearer of the leg apparel, and comprises at least one stimulus-inducing structure arranged on an inside of the leg apparel, wherein, in the worn state, the at least one stimulus-inducing structure faces toward the leg of the wearer of the leg apparel, wherein at least one of the at least one stimulus-inducing structure comprises a plurality of stimulus-inducing functional elements arranged within a stimulus induction zone delimited by an outer contour of the respective stimulus-inducing structure, wherein the plurality of functional elements of the at least one stimulus-inducing structure are isolated from one another and an area density of the plurality of functional elements within the at least one stimulus-inducing structure is at least 1 per $cm^2$, wherein the leg apparel comprises a basic knit material, wherein the plurality of functional elements each have a largest extent along a surface direction of the basic knit material of more than 0.2 cm and each comprise a knitted region of the basic knit material of the leg apparel, wherein the knitted region of each of the plurality of functional elements differs, with regard to a knitted construction of the knitted region of the respective functional element, from a knitted region of the basic knit material of the leg apparel adjoining and surrounding the respective functional element, wherein the knitted region of the respective functional element is configured as a tuck stitch fabric and contains a thread comprising an elastic polymer, and wherein the knitted region of the respective functional element comprises a plurality of tuck stitch loops that each extend over a plurality of stitch rows.

2. Leg apparel according to claim 1, wherein the at least one stimulus-inducing structure is arranged at least partially in the at least one compression region of the leg apparel.

3. Leg apparel according to claim 1, wherein, in the worn state, the at least one stimulus-inducing structure is in direct contact with the skin of the wearer of the leg apparel.

4. Leg apparel according to claim 1, wherein the leg apparel further includes a covering on the inside and, in the worn state, the at least one stimulus-inducing structure is separated from the skin of the wearer by the covering.

5. Leg apparel according to claim 1, wherein the at least one compression region of the leg apparel comprises at least one elastic yarn.

6. Leg apparel according to claim 1, wherein the at least one compression region has a compression strength that varies within the at least one compression region.

7. Leg apparel according to claim 1, wherein the at least one compression region has a maximum compression strength that is at least 7 mm Hg.

8. Leg apparel according to claim 1, wherein at least one of the at least one compression region comprises at least one of: at least one part of a middle foot region of the leg apparel, at least one part of an ankle region of the leg apparel and at least one part of a leg region of the leg apparel.

9. Leg apparel according to claim 1, wherein each of the plurality of functional elements is configured as a raised portion.

10. Leg apparel according to claim 1, wherein each of the plurality of functional elements contains at least one of a thermoplastic polymer and a thermosetting polymer.

11. Leg apparel according to claim 1, wherein the knitted region of the respective functional element contains a hot-melt adhesive thread.

12. Leg apparel according to claim 1, wherein each of the plurality of functional elements has a largest extent along a surface direction of the basic knit material of not more than 1.0 cm.

13. Leg apparel according to claim 1, wherein a height of each of the plurality of functional elements by which the respective functional element is configured to project, in the worn state, over the knitted region of the basic knit material of the leg apparel adjoining and surrounding the respective functional element toward the skin of the wearer is at least 0.1 cm.

14. Leg apparel according to claim 1, wherein each of the plurality of functional elements has a Shore A hardness of at least 20.

15. Leg apparel according to claim 1, wherein each of the plurality of functional elements is fixed to a base element of the leg apparel.

16. Leg apparel according to claim 1, wherein the at least one stimulus-inducing structure comprises at least one support element on which the plurality of functional elements is provided.

17. Leg apparel according to claim 16, wherein the at least one support element is fixed to a base element of the leg apparel.

18. Leg apparel according to claim 16, wherein the at least one support element is releasably connected to a base element of the leg apparel.

19. Leg apparel according to claim 1, wherein, in the worn state of the leg apparel, at least one of the at least one stimulus-inducing structure at least partially overlaps at least one of the tibialis anterior muscle/tendon structure and the peroneal muscles and tendons of the wearer of the leg apparel.

20. Leg apparel according to claim 1, wherein, in the worn state of the leg apparel, at least one of the at least one stimulus-inducing structure at least partially overlaps the musculus gastrocnemius muscle.

21. Leg apparel according to claim 1, wherein, in the worn state of the leg apparel, at least one of the at least one stimulus-inducing structure at least partially overlaps at least one of the musculus vastus medialis muscle and the musculus vastus lateralis muscle.

22. Leg apparel according to claim 1, wherein, in the worn state of the leg apparel, at least one of the at least one stimulus-inducing structure at least partially overlaps at least one of the musculus gluteus medius muscle, the musculus gluteus minimus muscle and the tractus iliotibialis fascia structure.

23. Leg apparel according to claim 1, wherein, in the worn state of the leg apparel, at least one of the at least one stimulus-inducing structure at least partially overlaps the musculus rectus femoris muscle.

24. Leg apparel according to claim 1, wherein, in the worn state of the leg apparel, at least one of the at least one stimulus-inducing structure at least partially overlaps the rear flexor muscles of the thigh.

25. Leg apparel according to claim 1, wherein the at least one stimulus-inducing structure includes a stimulus-inducing structure which, in the worn state of the leg apparel, is arranged to the left of the Achilles tendon, and a stimulus-inducing structure which, in the worn state of the leg apparel, is arranged to the right of the Achilles tendon.

26. Leg apparel according to claim 1, wherein the at least one stimulus-inducing structure includes at least two stimulus-inducing structures which are separated from one another by a region without any stimulus-inducing structure.

27. Leg apparel according to claim 1, wherein the leg apparel is provided with a marking which, in the worn state of the leg apparel, extends substantially along a longitudinal central plane of the leg apparel which separates an inward side of the leg apparel from an outward side of the leg apparel.

28. Leg apparel according to claim 1, wherein at least one of the plurality of functional elements has a rectangular outer contour.

29. Leg apparel according to claim 1, wherein each of the plurality of functional elements of at least one of the at least one stimulus-inducing structure has a rectangular outer contour.

30. Leg apparel according to claim 1, wherein the leg apparel is configured as a stocking, trousers, a leg warmer or leggings.

31. Leg apparel according to claim 1, wherein, in the worn state of the leg apparel, the outer contour of at least one of the at least one stimulus-inducing structure corresponds to an outer contour of at least one of the musculus gastrocnemius muscle, the musculus vastus medialis muscle, the musculus vastus lateralis muscle, the musculus gluteus medius muscle, the musculus gluteus minimus muscle, the tractus iliotibialis fascia structure, the musculus rectus femoris muscle and the rear flexor muscles of the thigh.

32. Leg apparel according to claim 31, wherein each of the plurality of functional elements has a largest extent along a surface direction of the basic knit material of not more than 1.0 cm.

* * * * *